US011377926B2

(12) United States Patent
Watson et al.

(10) Patent No.: US 11,377,926 B2
(45) Date of Patent: Jul. 5, 2022

(54) PLUGGING DEVICE DEPLOYMENT

(71) Applicant: THRU TUBING SOLUTIONS, INC., Oklahoma City, OK (US)

(72) Inventors: Brock W. Watson, Sadler, TX (US); Gary P. Funkhouser, Moore, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 0 days.

(21) Appl. No.: 16/931,322

(22) Filed: Jul. 16, 2020

(65) Prior Publication Data

US 2020/0347695 A1 Nov. 5, 2020

Related U.S. Application Data

(63) Continuation of application No. 15/745,608, filed as application No. PCT/US2016/029357 on Apr. 26, 2016, now Pat. No. 10,753,174.

(60) Provisional application No. 62/195,078, filed on Jul. 21, 2015.

(51) Int. Cl.

| | |
|---|---|
| ***E21B 33/13*** | (2006.01) |
| ***E21B 41/00*** | (2006.01) |
| *E21B 43/11* | (2006.01) |

(52) U.S. Cl.

CPC ..... *E21B 33/13* (2013.01); *E21B 41/00* (2013.01); *E21B 43/11* (2013.01)

(58) Field of Classification Search

CPC ..... E21B 33/13; E21B 41/00; E21B 43/11; E21B 34/06; E21B 43/26

See application file for complete search history.

(56) References Cited

U.S. PATENT DOCUMENTS

| | | | |
|---|---|---|---|
| 2,157,493 | A | 5/1939 | Miller et al. |
| 2,754,910 | A | 7/1956 | Derrick et al. |
| 2,768,693 | A | 10/1956 | Hughes, Jr. |
| 2,788,072 | A | 4/1957 | Goodwin |
| 2,838,117 | A | 6/1958 | Clark, Jr. et al. |

(Continued)

FOREIGN PATENT DOCUMENTS

| | | | |
|---|---|---|---|
| WO | 2007066254 | A2 | 7/2007 |
| WO | 2014042552 | A1 | 3/2014 |
| WO | 2017014820 | A1 | 1/2017 |

OTHER PUBLICATIONS

Argentina Office Action dated Aug. 13, 2020 for AR Patent Application No. 20160101168, 5 pages.

(Continued)

*Primary Examiner* — Caroline N Butcher
(74) *Attorney, Agent, or Firm* — Smith IP Services, P.C.

(57) ABSTRACT

A method of deploying plugging devices in a well can include a spacing between the plugging devices by controlling a ratio flow rates through intersecting pipes. A deployment apparatus can include an actuator and a release structure that releases the plugging devices into a conduit connected to a tubular string in the well. Another method of deploying plugging devices in a well can include operating an actuator, thereby displacing a release structure, and the release structure releasing the plugging devices into the well in response to operating the actuator. Another deployment apparatus can include intersecting pipes and a valve that selectively permits and prevents displacement of the plugging devices through one of the pipes.

14 Claims, 14 Drawing Sheets

(56) References Cited

U.S. PATENT DOCUMENTS 2,970,645 A 2/1961 Glass
3,028,914 A 4/1962 Flickinger
3,170,517 A 2/1965 Graham et al.
3,174,546 A 3/1965 Flickinger
3,376,934 A 4/1968 Willman et al.
3,399,726 A 9/1968 Harris et al.
3,417,821 A 12/1968 Tinsley et al.
3,434,539 A 3/1969 Merritt
3,437,147 A 4/1969 Davies
3,595,314 A 7/1971 Garner
3,707,194 A 12/1972 Svaldi
3,814,187 A 6/1974 Holamn
3,895,678 A 7/1975 Wright et al.
4,194,561 A 3/1980 Stokley et al.
4,244,425 A 1/1981 Erbstoesser
4,505,334 A 3/1985 Doner et al.
4,716,964 A 1/1988 Erbstoesser et al.
4,921,577 A 5/1990 Eubank
5,004,048 A 4/1991 Bode
5,253,709 A 10/1993 Kendrick et al.
5,507,345 A 4/1996 Wehunt, Jr. et al.
5,890,536 A 4/1999 Nierode et al.
5,908,073 A 6/1999 Nguyen et al.
6,070,666 A 6/2000 Montgomery
6,394,184 B2 5/2002 Tolman et al.
6,427,776 B1 8/2002 Hoffman et al.
6,543,538 B2 4/2003 Tolman et al.
6,655,475 B1 12/2003 Wald
7,225,869 B2 6/2007 Willet et al.
7,273,099 B2 9/2007 East, Jr. et al.
7,451,823 B2 11/2008 Wilson
7,527,095 B2 5/2009 Bloess et al.
7,565,929 B2 7/2009 Bustos et al.
7,571,773 B1 8/2009 West et al.
7,673,673 B2 3/2010 Surjaatmadja et al.
7,748,452 B2 7/2010 Sullivan et al.
7,810,567 B2 10/2010 Daniels et al.
7,874,365 B2 1/2011 East, Jr. et al.
7,891,424 B2 2/2011 Creel et al.
8,088,717 B2 1/2012 Polizzotti et al.
8,240,392 B2 8/2012 Barnard et al.
8,256,515 B2 9/2012 Barbee
8,281,860 B2 10/2012 Boney et al.
8,307,916 B1 11/2012 Wald
8,596,362 B2 12/2013 Nelson
8,646,529 B2 2/2014 Clark et al.
8,757,260 B2 6/2014 Luo et al.
8,776,886 B2 7/2014 Rondeau
8,851,172 B1 10/2014 Dudzinski
8,853,137 B2 10/2014 Todd et al.
8,887,803 B2 11/2014 East, Jr. et al.
8,950,438 B2 2/2015 Ryan
8,950,491 B2 2/2015 Frost
9,187,975 B2 11/2015 Rochen
9,284,798 B2 3/2016 Jamison et al.
9,334,704 B2 5/2016 Mineo et al.
9,551,204 B2 1/2017 Schultz et al.
9,567,824 B2 2/2017 Watson et al.
9,567,825 B2 2/2017 Schultz et al.
9,567,826 B2 2/2017 Schultz et al.
9,708,883 B2 7/2017 Schultz et al.
9,745,820 B2 8/2017 Watson et al.
9,816,341 B2 11/2017 Funkhouser et al.
10,233,719 B2 3/2019 Schultz et al.
10,513,653 B2 12/2019 Schultz et al.
10,513,902 B2 12/2019 Funkhouser et al.
10,641,057 B2 5/2020 Schultz et al.
10,641,069 B2 5/2020 Schultz et al.
10,641,070 B2 5/2020 Schultz et al.
10,655,427 B2 5/2020 Schultz et al.
10,738,564 B2 8/2020 Watson et al.
2004/0129460 A1 7/2004 Macquoid et al.
2005/0184083 A1* 8/2005 Diaz ..... E21B 33/138 221/75
2006/0113077 A1 6/2006 Willberg et al.
2006/0169449 A1 8/2006 Mang et al.
2006/0213662 A1 9/2006 Creel et al.
2007/0169935 A1* 7/2007 Akbar ..... E21B 33/138 166/284
2007/0187099 A1 8/2007 Wang
2008/0000639 A1 1/2008 Clark et al.
2008/0128133 A1 6/2008 Turley et al.
2008/0196896 A1 8/2008 Bustos et al.
2010/0122813 A1 5/2010 Trummer et al.
2010/0147886 A1 6/2010 Witkowski et al.
2010/0152070 A1 6/2010 Ghassemzadeh
2011/0048712 A1* 3/2011 Barbee ..... E21B 33/05 166/291
2011/0226479 A1 9/2011 Tippel et al.
2011/0278011 A1 11/2011 Crainich, Jr. et al.
2011/0297396 A1 12/2011 Hendel et al.
2012/0085548 A1 4/2012 Fleckenstein et al.
2012/0181032 A1 7/2012 Naedler et al.
2012/0211219 A1* 8/2012 McGuire ..... E21B 33/05 166/75.15
2012/0285659 A1 11/2012 Lafferty et al.
2013/0098600 A1 4/2013 Roberts
2013/0186632 A1 7/2013 Makowiecki et al.
2013/0199800 A1 8/2013 Kellner et al.
2013/0233553 A1 9/2013 Bugrin et al.
2014/0022537 A1 1/2014 Samson et al.
2014/0116712 A1 5/2014 Bansal et al.
2014/0274815 A1 9/2014 Lovett et al.
2014/0299334 A1 10/2014 Hallundbaek et al.
2015/0060072 A1 3/2015 Busby et al.
2015/0075793 A1 3/2015 Dotson et al.
2015/0083423 A1 3/2015 Brannon et al.
2015/0090453 A1 4/2015 Tolman et al.
2015/0122364 A1 5/2015 Cheatham, III et al.
2016/0130933 A1 5/2016 Madasu
2016/0251930 A1 9/2016 Jacob et al.
2017/0030169 A1 2/2017 Funkhouser et al.
2017/0107784 A1 4/2017 Watson et al.
2017/0107786 A1 4/2017 Schultz et al.
2017/0253788 A1 9/2017 Ivanov et al.
2017/0260828 A1 9/2017 Watson et al.
2017/0275961 A1 9/2017 Schultz et al.
2017/0275965 A1 9/2017 Watson et al.
2017/0292343 A1 10/2017 Watson
2017/0335651 A1 11/2017 Watson et al.

OTHER PUBLICATIONS

Office Action dated Sep. 21, 2020 for U.S. Appl. No. 16/987,094, 60 pages.
Office Action dated Oct. 2, 2020 for U.S. Appl. No. 16/264,758, 9 pages.
U.S. Office Action dated Jun. 9, 2021 for U.S. Appl. No. 16/402,396, 61 pages.
Examiner's Report dated Jan. 14, 2021 for CA Patent Application No. 3,064,076, 4 pages.
GCC Examination Report dated Dec. 24, 2018 for GCC Patent Application No. 2016-31224, 4 pages.
Australian Examination Report dated Feb. 18, 2019 for AU Patent Application No. 2017219082, 3 pages.
GCC Examination Report dated Dec. 24, 2018 for GCC Patent Application No. 2016-31223, 4 pages.
Office Action dated Jan. 29, 2019 for U.S. Appl. No. 15/622,016, 22 pages.
Australian Examination Report dated Feb. 18, 2019 for AU Patent Application No. 2017279758, 3 pages.
Office Action dated Feb. 4, 2019 for U.S. Appl. No. 15/567,779, 58 pages.
Office Action dated Feb. 11, 2019 for U.S. Appl. No. 16/214,174, 17 pages.
Office Action dated Feb. 11, 2019 for U.S. Appl. No. 16/238,838, 25 pages.
Australian Examination Report dated Feb. 26, 2019 for AU Patent Application No. 2017276220, 4 pages.
Office Action dated Mar. 18, 2019 for U.S. Appl. No. 15/658,697, 34 pages.

(56) References Cited

OTHER PUBLICATIONS

Office Action dated Mar. 18, 2019 for U.S. Appl. No. 15/726,160, 62 pages.
GCC Examination Report dated Dec. 23, 2018 for GCC Patent Application No. 2016-31222, 4 pages.
Perf Sealers; "History of Perforation Ball Sealers in the Oil and Gas Industry", company website article, dated 2014-2019, 4 pages.
Office Action dated Mar. 20, 2019 for U.S. Appl. No. 15/432,041, 39 pages.
Examination Report dated Dec. 24, 2018 for GCC Patent Application No. 2016-31224, 4 pages.
Examination Report dated Apr. 2, 2019 for GCC Patent Application No. 2016-31243, 4 pages.
Examination Report dated Mar. 2, 2019 for GCC Patent Application No. 2016-31242, 4 pages.
Oxford Dictionaries; "body", definition of body in English, dated May 23, 2019, 7 pages.
Office Action dated May 29, 2019 for U.S. Appl. No. 15/567,779, 18 pages.
Office Action dated May 29, 2019 for U.S. Appl. No. 16/214,174, 26 pages.
Canadian Office Action dated Apr. 11, 2019 for CA Patent Application No. 2,992,712, 4 pages.
Examination Report dated Mar. 6, 2019 for GCC Patent Application No. 2017-34211, 4 pages.
Specifications and drawings for U.S. Appl. No. 16/402,396, filed May 3, 2019, 93 pages.
Canadian Office Action dated Aug. 2, 2019 for CA Patent Application No. 3,019,772, 5 pages.
GCC Examination Report dated Jun. 17, 2019 for GCC Patent Application No. 2016-36182, 3 pages.
Office Action dated Oct. 11, 2019 for U.S. Appl. No. 15/567,779, 33 pages.
Office Action dated Sep. 23, 2019 for U.S. Appl. No. 16/214,174, 26 pages.
Lexico Dictionary; "body", Definition of body in English, dated Sep. 17, 2019, 7 pages.
Lexico Dictionary; "knot", Main definitions of knot in English, dated Sep. 17, 2019, 8 pages.
Examiner's Answer dated Sep. 25, 2019 for U.S. Appl. No. 15/658,697, 26 pages.
Office Action dated Oct. 23, 2019 for U.S. Appl. No. 15/745,608, 69 pages.
Office Action dated Apr. 6, 2020 for U.S. Appl. No. 15/745,608, 26 pages.
International Search Report with Written Opinion dated Jan. 26, 2016 for PCT Patent Application No. PCT/US15/038248, 16 pages.
Office Action dated Apr. 13, 2016 for U.S. Appl. No. 14/698,578, 27 pages.
Office Action dated Apr. 13, 2016 for U.S. Appl. No. 14/966,812, 27 pages.
"Fabric." Merriam-Webster.com. Merriam-Webster, n.d. Web. Apr. 5, 2016, 6 pages.
"Rope." Merriam-Webster.com. Merriam-Webster, n.d. Web. Apr. 5, 2016, 10 pages.
Specification and drawings for U.S. Appl. No. 15/062,669, filed Mar. 7, 2016, 44 pages.
Specification and drawings for U.S. Appl. No. 15/138,327, filed Apr. 26, 2016, 59 pages.
Specification and drawings for U.S. Appl. No. 15/138,378, filed Apr. 26, 2016, 43 pages.
Specification and drawings for U.S. Appl. No. 15/138,408, filed Apr. 26, 2016, 43 pages.
Specification and drawings for U.S. Appl. No. 15/138,449, filed Apr. 26, 2016, 56 pages.
Specification and drawings for Patent Application No. PCT/US16/29314 filed Apr. 26, 2016, 55 pages.
Specification and drawings for U.S. Appl. No. 15/138,685, filed Apr. 26, 2016, 64 pages.
Specification and drawings for U.S. Appl. No. 15/138,968, filed Apr. 26, 2016, 107 pages.
Specification and drawings for U.S. Appl. No. 14/698,578, filed Apr. 28, 2015, 36 pages.
Specification and drawings for Patent Application No. PCT/US16/29357 filed Apr. 26, 2016, 50 pages.
Specification and drawings for Patent Application No. PCT/US15/38248 filed Jun. 29, 2015, 39 pages.
MONOSOL; "Film Data Sheet", product information brochure, dated Mar. 6, 2012, 1 page.
Specification and drawings for U.S. Appl. No. 15/296,342, filed Oct. 18, 2016, 120 pages.
Specification and drawings for PCT Patent Application No. PCT/US16/57514, filed Oct. 18, 2016, 120 pages.
Office Action dated May 5, 2017 for U.S. Appl. No. 15/347,535, 20 pages.
Office Action dated May 9, 2017 for U.S. Appl. No. 15/138,685, 42 pages.
Office Action dated May 12, 2017 for U.S. Appl. No. 15/296,342, 23 pages.
Office Action dated Jul. 11, 2017 for U.S. Appl. No. 15/622,016, 16 pages.
Office Action dated Jul. 13, 2017 for U.S. Appl. No. 15/615,136, 13 pages.
Office Action dated Jul. 14, 2017 for U.S. Appl. No. 15/391,014, 24 pages.
Office Action dated Jul. 17, 2017 for U.S. Appl. No. 15/138,685, 21 pages.
"Yarn"; Definition of Yarn by Merriam-Webster.com, Merrian-Webster, n.d. Web., Aug. 11, 2017, 6 pages.
Specification and Drawings for U.S. Appl. No. 15/567,779, filed Oct. 19, 2017, 63 pages.
Office Action dated Nov. 3, 2017 for U.S. Appl. No. 15/138,685, 15 pages.
Office Action dated Nov. 7, 2017 for U.S. Appl. No. 15/162,334, 16 pages.
Office Action dated Nov. 13, 2017 for U.S. Appl. No. 15/622,016, 44 pages.
Office Action dated Nov. 13, 2017 for U.S. Appl. No. 15/615,136, 34 pages.
Examiner's Answer dated Nov. 15, 2017 for U.S. Appl. No. 15/347,535, 14 pages.
Canadian Office Action dated Dec. 13, 2017 for CA Patent Application No. 2,957,681, 3 pages.
Australian Examination Report dated Jan. 18, 2018 for AU Patent Application No. 2015393421, 3 pages.
Examiner's Report dated Mar. 28, 2018 for U.S. Appl. No. 15/390,976, 10 pages.
Examiner's Report dated Mar. 28, 2018 for U.S. Appl. No. 15/391,014, 14 pages.
Office Action dated Mar. 29, 2018 for U.S. Appl. No. 15/622,016, 28 pages.
Office Action dated Apr. 20, 2018 for U.S. Appl. No. 15/138,685, 27 pages.
Office Action dated Mar. 30, 2018 for U.S. Appl. No. 15/615,136, 28 pages.
GCC Examination Report dated May 28, 2018 for GCC Patent Application No. 2016-31218, 4 pages.
GCC Examination Report dated May 28, 2018 for GCC Patent Application No. 2016-31220, 4 pages.
GCC Examination Report dated May 27, 2018 for GCC Patent Application No. 2016-31217, 4 pages.
GCC Examination Report dated May 27, 2018 for GCC Patent Application No. 2016-31216, 4 pages.
International Search Report with Written Opinion dated Aug. 1, 2018 for PCT Patent Application No. PCT/US2018/029395, 20 pages.
International Search Report with Written Opinion dated Aug. 2, 2018 for PCT Patent Application No. PCT/US2018/029383, 20 pages.
GCC Examination Report dated Jun. 3, 2018 for GCC Patent Application No. 2016-31222, 4 pages.

(56) References Cited

OTHER PUBLICATIONS

Canadian Office Action dated Dec. 9, 2019 for CA Patent Application No. 3,019,772, 4 pages.
Canadian Examiner's Report dated May 28, 2020 for CA Patent Application No. 3,042,045, 3 pages.
Australian Examiner's Report dated Jun. 9, 2020 for AU Patent Application No. 216297438, 5 pages.
Office Action dated Jun. 11, 2018 for U.S. Appl. No. 15/658,697, 52 pages.
Office Action dated Jul. 20, 2018 for U.S. Appl. No. 15/615,136, 14 pages.
Australian Examination Report dated Jul. 11, 2018 for AU Patent Application No. 53026THR/MRR, 3 pages.
GCC Examination Report dated Jul. 18, 2018 for GCC Patent Application No. GC 2016-31224, 4 pages.
GCC Examination Report dated Jul. 18, 2018 for GCC Patent Application No. GC 2016-31223, 4 pages.
Office Action dated Oct. 9, 2018 for U.S. Appl. No. 15/658,697, 24 pages.
Canadian Office Action dated Nov. 23, 2018 for CA Patent Application No. 2,995,533, 4 pages.
Australian Examination Report dated Nov. 14, 2018 for AU Patent Application No. 2017218948, 5 pages.
Australian Examination Report dated Nov. 2, 2018 for AU Patent Application No. 2017219089, 5 pages.
Canadian Office Action dated Oct. 16, 2018 for CA Patent Application No. 2,992,712, 5 pages.
Canadian Office Action dated Nov. 30, 2018 for CA Patent Application No. 2,957,681, 3 pages.
Office Action dated Dec. 13, 2018 for U.S. Appl. No. 15/390,941, 11 pages.
International Search Report with Written Opinion dated Dec. 3, 2018 for PCT Patent Application No. PCT/US2017/059644, 20 pages.
Office Action dated Sep. 24, 2021 for U.S. Appl. No. 16/402,396, 16 pages.
Advisory Action dated Dec. 6, 2021 for U.S. Appl. No. 16/402,396, 5 pages.
Office Action dated Mar. 15, 2022 for U.S. Appl. No. 16/402,396, 12 pages.

* cited by examiner

PLUGGING DEVICE DEPLOYMENT

CROSS-REFERENCE TO RELATED APPLICATIONS

This application is a continuation of prior U.S. application Ser. No. 15/745,608 filed on 17 Jan. 2018, which is a national stage under 35 USC 371 of International Application No. PCT/US16/29357, filed on 26 Apr. 2016, which claims the benefit of the filing date of U.S. provisional application Ser. No. 62/195,078 filed 21 Jul. 2015. The entire disclosures of these prior applications are incorporated herein in their entireties by this reference.

BACKGROUND

This disclosure relates generally to equipment utilized and operations performed in conjunction with a subterranean well and, in one example described below, more particularly provides for deployment of plugging devices in wells.

It can be beneficial to be able to control how and where fluid flows in a well. For example, it may be desirable in some circumstances to be able to prevent fluid from flowing into a particular formation zone. As another example, it may be desirable in some circumstances to cause fluid to flow into a particular formation zone, instead of into another formation zone. Therefore, it will be readily appreciated that improvements are continually needed in the art of controlling fluid flow in wells.

DETAILED DESCRIPTION

Figure 1:
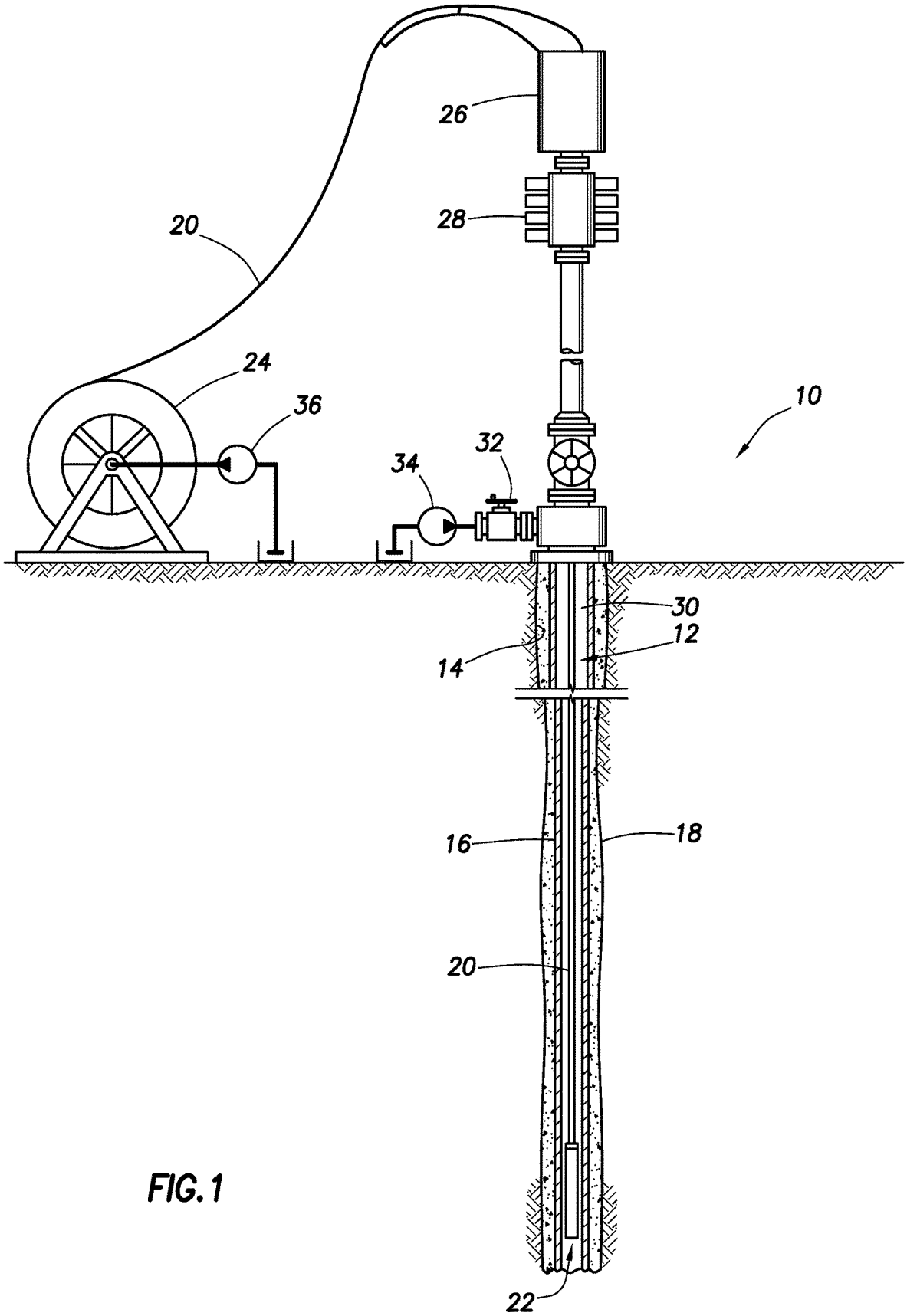
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is conveyed into a wellbore 14 lined with casing 16 and cement 18. Although multiple casing strings would typically be used in actual practice, for clarity of illustration only one casing string 16 is depicted in the drawings.

Although the wellbore 14 is illustrated as being vertical, sections of the wellbore could instead be horizontal or otherwise inclined relative to vertical. Although the wellbore 14 is completely cased and cemented as depicted in FIG. 1, any sections of the wellbore in which operations described in more detail below are performed could be uncased or open hole. Thus, the scope of this disclosure is not limited to any particular details of the system 10 and method.

The tubular string 12 of FIG. 1 comprises coiled tubing 20 and a bottom hole assembly 22. As used herein, the term "coiled tubing" refers to a substantially continuous tubing that is stored on a spool or reel 24. The reel 24 could be mounted, for example, on a skid, a trailer, a floating vessel, a vehicle, etc., for transport to a wellsite. Although not shown in FIG. 1, a control room or cab would typically be provided with instrumentation, computers, controllers, recorders, etc., for controlling equipment such as an injector 26 and a blowout preventer stack 28.

As used herein, the term "bottom hole assembly" refers to an assembly connected at a distal end of a tubular string in a well. It is not necessary for a bottom hole assembly to be positioned or used at a "bottom" of a hole or well.

When the tubular string 12 is positioned in the wellbore 14, an annulus 30 is formed radially between them. Fluid, slurries, etc., can be flowed from surface into the annulus 30 via, for example, a casing valve 32. One or more pumps 34 may be used for this purpose. Fluid can also be flowed to surface from the wellbore 14 via the annulus 30 and valve 32.

Fluid, slurries, etc., can also be flowed from surface into the wellbore 14 via the tubing 20, for example, using one or more pumps 36. Fluid can also be flowed to surface from the wellbore 14 via the tubing 20.

In the further description below of the examples of FIGS. 2A-9, one or more flow conveyed devices are used to block or plug openings in the system 10 of FIG. 1. However, it should be clearly understood that these methods and the flow conveyed device may be used with other systems, and the flow conveyed device may be used in other methods in keeping with the principles of this disclosure.

The example methods described below allow existing fluid passageways to be blocked permanently or temporarily in a variety of different applications. Certain flow conveyed device examples described below are made of a fibrous material and comprise a "knot" or other enlarged geometry.

The devices are conveyed into leak paths using pumped fluid. The fibrous material "finds" and follows the fluid flow, pulling the enlarged geometry into a restricted portion of a flow path, causing the enlarged geometry and additional strands to become tightly wedged into the flow path thereby sealing off fluid communication.

The devices can be made of degradable or non-degradable materials. The degradable materials can be either self-degrading, or can require degrading treatments, such as, by exposing the materials to certain acids, certain base compositions, certain chemicals, certain types of radiation (e.g., electromagnetic or "nuclear"), or elevated temperature. The exposure can be performed at a desired time using a form of well intervention, such as, by spotting or circulating a fluid in the well so that the material is exposed to the fluid.

In some examples, the material can be an acid degradable material (e.g., nylon, etc.), a mix of acid degradable material (for example, nylon fibers mixed with particulate such as calcium carbonate), self-degrading material (e.g., poly-lactic acid (PLA), poly-glycolic acid (PGA), etc.), material that degrades by galvanic action (such as, magnesium alloys, aluminum alloys, etc.), a combination of different self-degrading materials, or a combination of self-degrading and non-self-degrading materials.

Multiple materials can be pumped together or separately. For example, nylon and calcium carbonate could be pumped as a mixture, or the nylon could be pumped first to initiate a seal, followed by calcium carbonate to enhance the seal.

In certain examples described below, the device can be made of knotted fibrous materials. Multiple knots can be used with any number of loose ends. The ends can be frayed or un-frayed. The fibrous material can be rope, fabric, cloth or another woven or braided structure.

The device can be used to block open sleeve valves, perforations or any leak paths in a well (such as, leaking connections in casing, corrosion holes, etc.). Any opening through which fluid flows can be blocked with a suitably configured device.

In one example method described below, a well with an existing perforated zone can be re-completed. Devices (either degradable or non-degradable) are conveyed by flow to plug all existing perforations.

The well can then be re-completed using any desired completion technique. If the devices are degradable, a degrading treatment can then be placed in the well to open up the plugged perforations (if desired).

In another example method described below, multiple formation zones can be perforated and fractured (or otherwise stimulated, such as, by acidizing) in a single trip of the bottom hole assembly 22 into the well. In the method, one zone is perforated, the zone is fractured or otherwise stimulated, and then the perforated zone is plugged using one or more devices.

These steps are repeated for each additional zone, except that a last zone may not be plugged. All of the plugged zones are eventually unplugged by waiting a certain period of time (if the devices are self-degrading), by applying an appropriate degrading treatment, or by mechanically removing the devices.

Referring specifically now to FIGS. 2A-D, steps in an example of a method in which the bottom hole assembly 22 of FIG. 1 can be used in re-completing a well are representatively illustrated. In this method (see FIG. 2A), the well has existing perforations 38 that provide for fluid communication between an earth formation zone 40 and an interior of the casing 16. However, it is desired to re-complete the zone 40, in order to enhance the fluid communication.

Figure 2A:
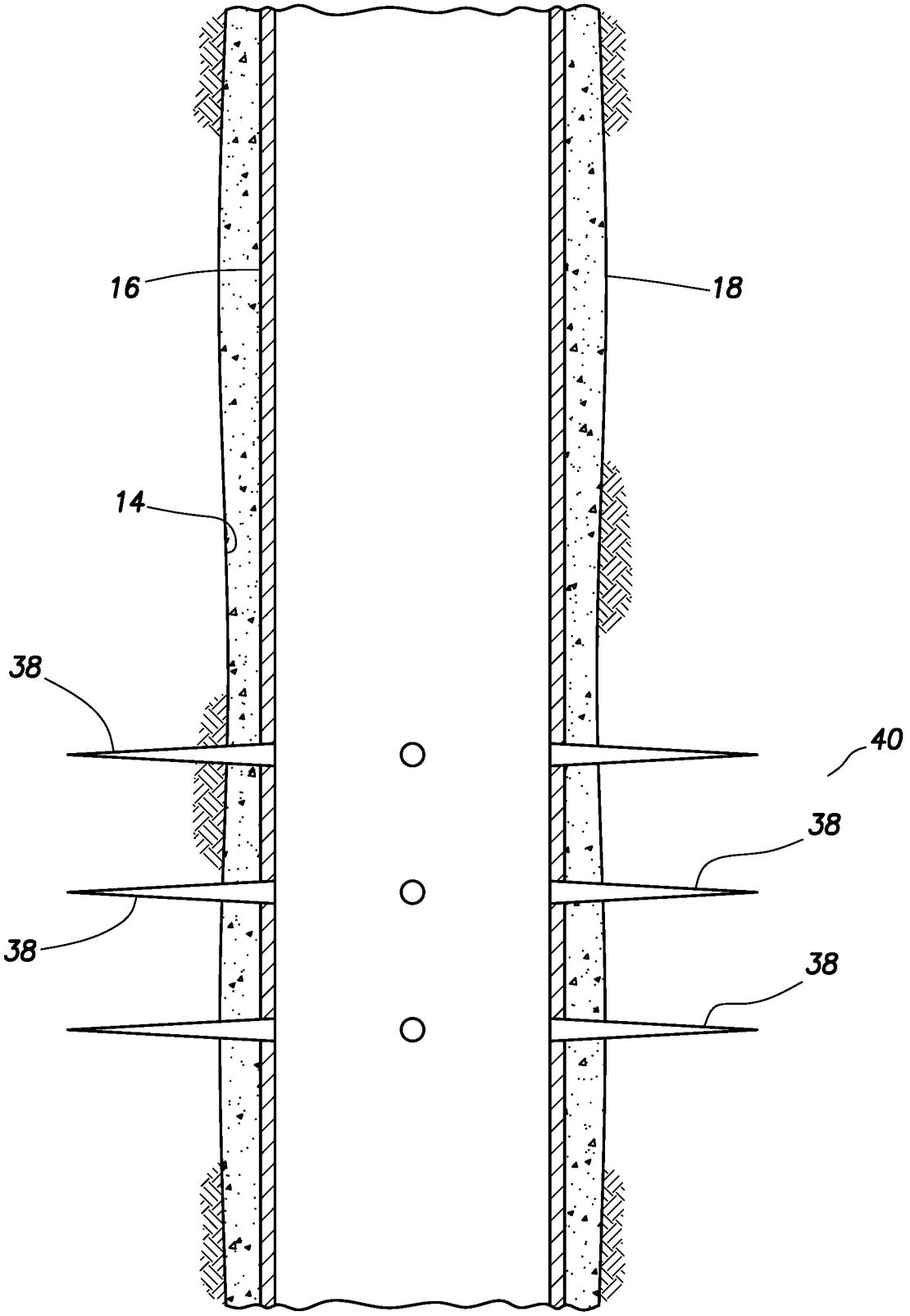
FIGS. 2A-D are enlarged scale representative partially cross-sectional views of steps in an example of a re-completion method that may be practiced with the system of FIG. 1.
Figure 2B:
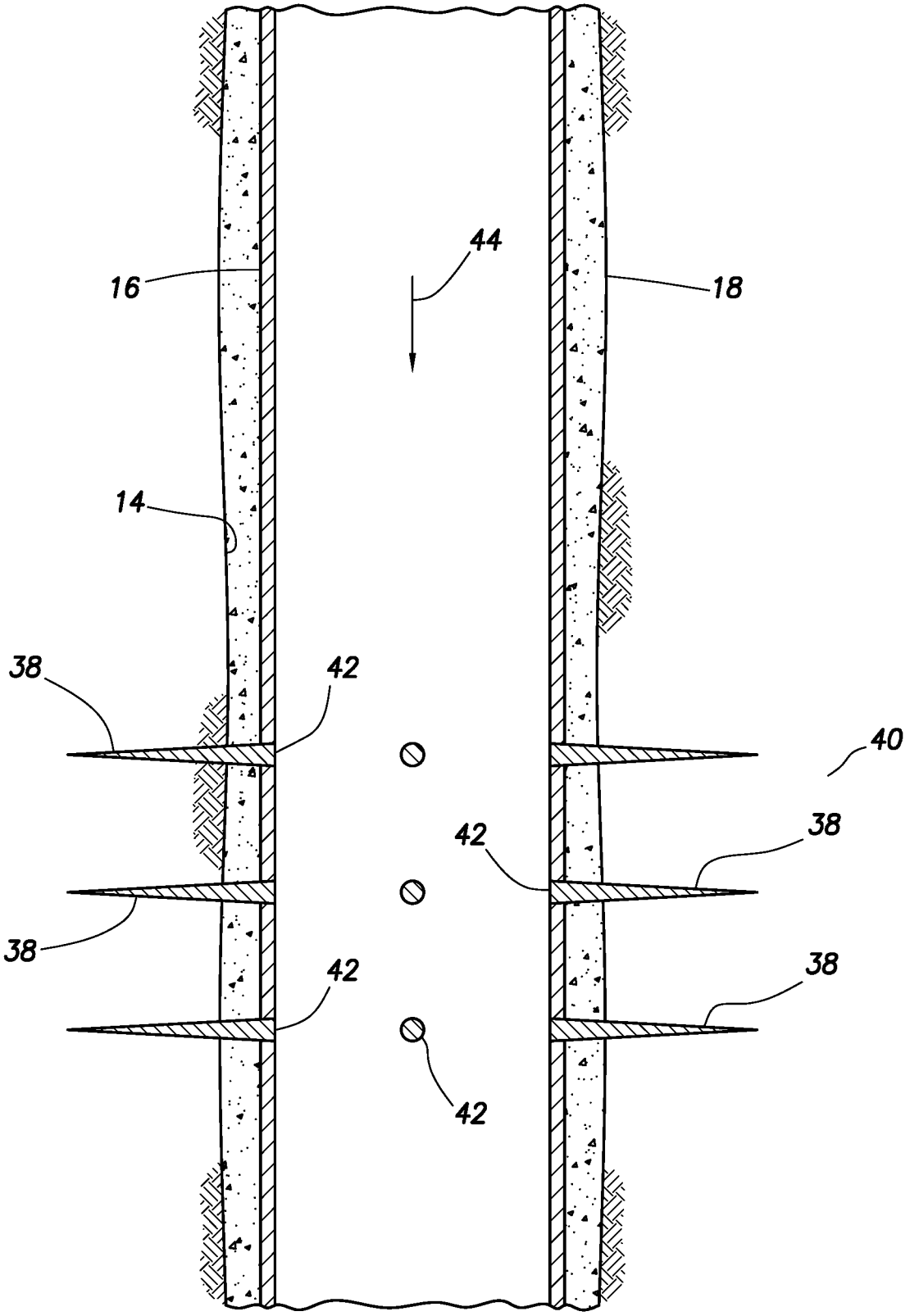

Referring additionally now to FIG. 2B, the perforations 38 are plugged, thereby preventing flow through the perforations into the zone 40. Plugs 42 in the perforations can be flow conveyed devices, as described more fully below. In that case, the plugs 42 can be conveyed through the casing 16 and into engagement with the perforations 38 by fluid flow 44.

Figure 2C:
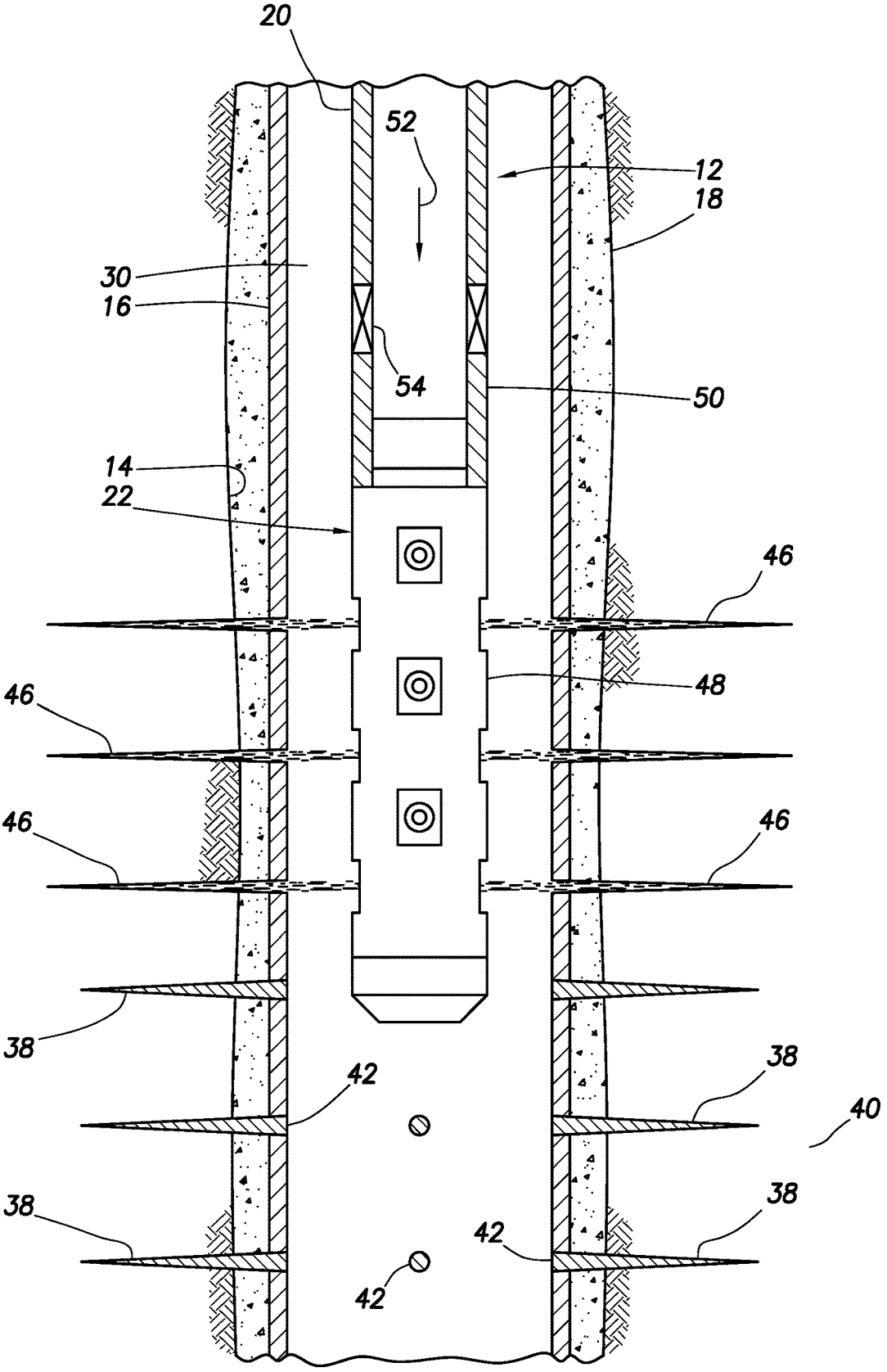

Referring additionally now to FIG. 2C, new perforations 46 are formed through the casing 16 and cement 18 by use of an abrasive jet perforator 48. In this example, the bottom hole assembly 22 includes the perforator 48 and a circulating valve assembly 50. Although the new perforations 46 are depicted as being formed above the existing perforations 38, the new perforations could be formed in any location in keeping with the principles of this disclosure.

Note that other means of providing perforations 46 may be used in other examples. Explosive perforators, drills, etc., may be used if desired. The scope of this disclosure is not limited to any particular perforating means, or to use with perforating at all.

The circulating valve assembly 50 controls flow between the coiled tubing 20 and the perforator 48, and controls flow between the annulus 30 and an interior of the tubular string 12. Instead of conveying the plugs 42 into the well via flow 44 through the interior of the casing 16 (see FIG. 2B), in other examples the plugs could be deployed into the tubular string 12 and conveyed by fluid flow 52 through the tubular string prior to the perforating operation. In that case, a valve 54 of the circulating valve assembly 50 could be opened to allow the plugs 42 to exit the tubular string 12 and flow into the interior of the casing 16 external to the tubular string.

Figure 2D:
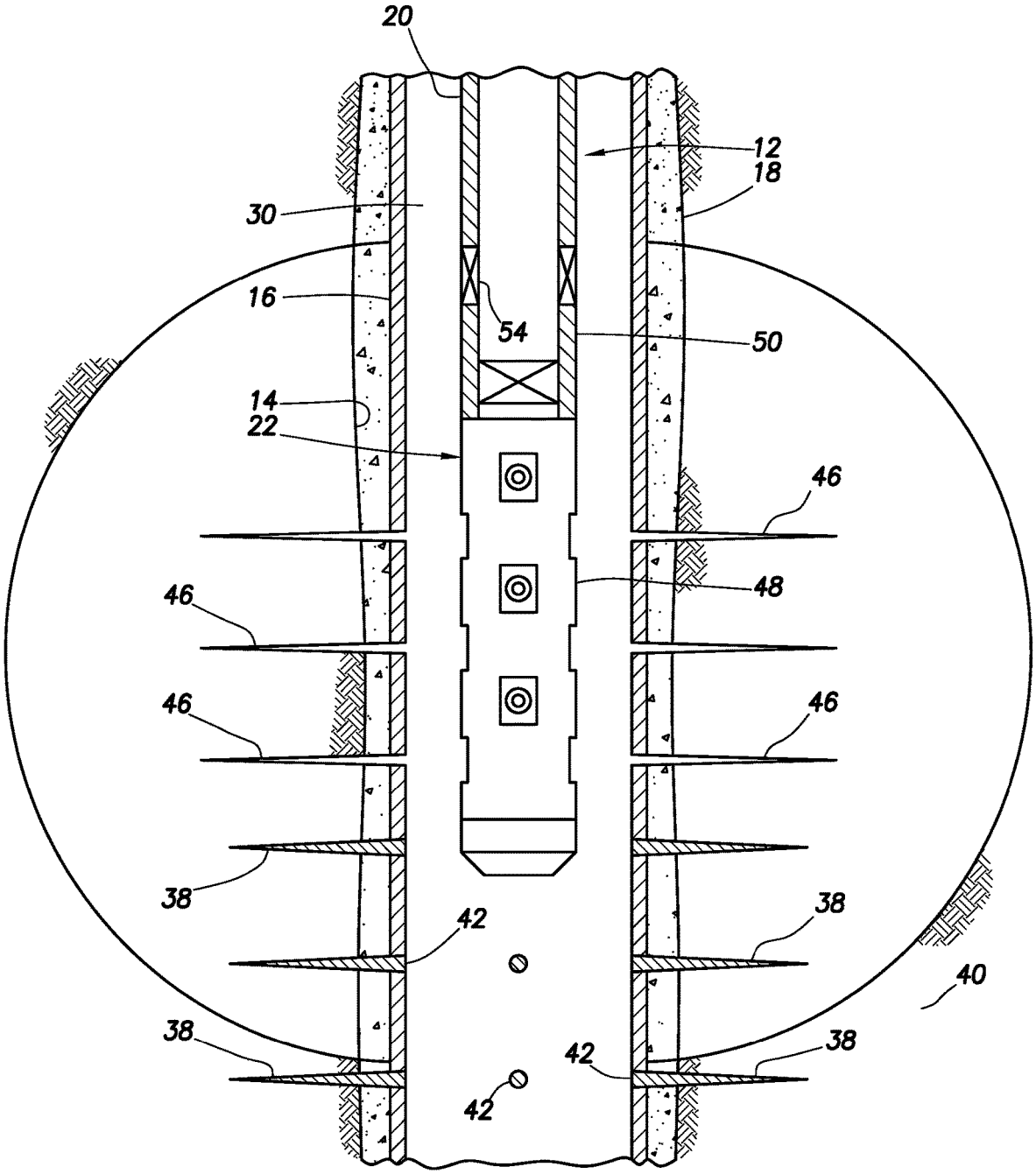

Referring additionally now to FIG. 2D, the zone 40 has been fractured or otherwise stimulated by applying increased pressure to the zone after the perforating operation. Enhanced fluid communication is now permitted between the zone 40 and the interior of the casing 16. Note that fracturing is not necessary in keeping with the principles of this disclosure.

In the FIG. 2D example, the plugs 42 prevent the pressure applied to stimulate the zone 40 via the perforations 46 from leaking into the zone via the perforations 38. The plugs 42 may remain in the perforations 38 and continue to prevent flow through the perforations, or the plugs may degrade, if desired, so that flow is eventually permitted through the perforations.

Referring additionally now to FIGS. 3A-D, steps in another example of a method in which the bottom hole assembly 22 of FIG. 1 can be used in completing multiple zones 40*a-c* of a well are representatively illustrated. The multiple zones 40*a-c* are each perforated and fractured during a single trip of the tubular string 12 into the well.

Figure 3A:
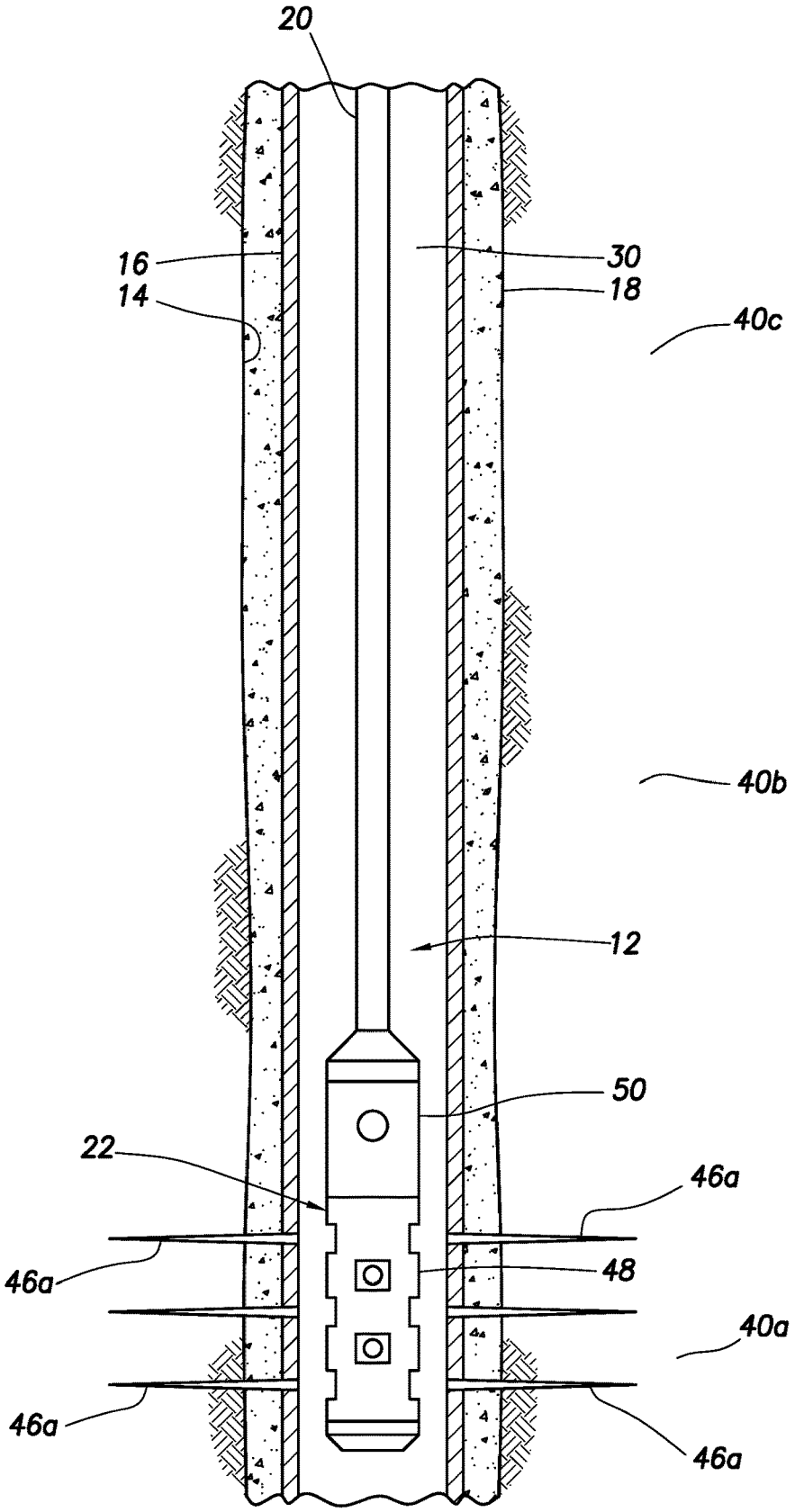
FIGS. 3A-D are representative partially cross-sectional views of steps in another example of a method that may be practiced with the system of FIG. 1.

In FIG. 3A, the tubular string 12 has been deployed into the casing 16, and has been positioned so that the perforator 48 is at the first zone 40*a* to be completed. The perforator 48 is then used to form perforations 46*a* through the casing 16 and cement 18, and into the zone 40*a*.

Figure 3B:
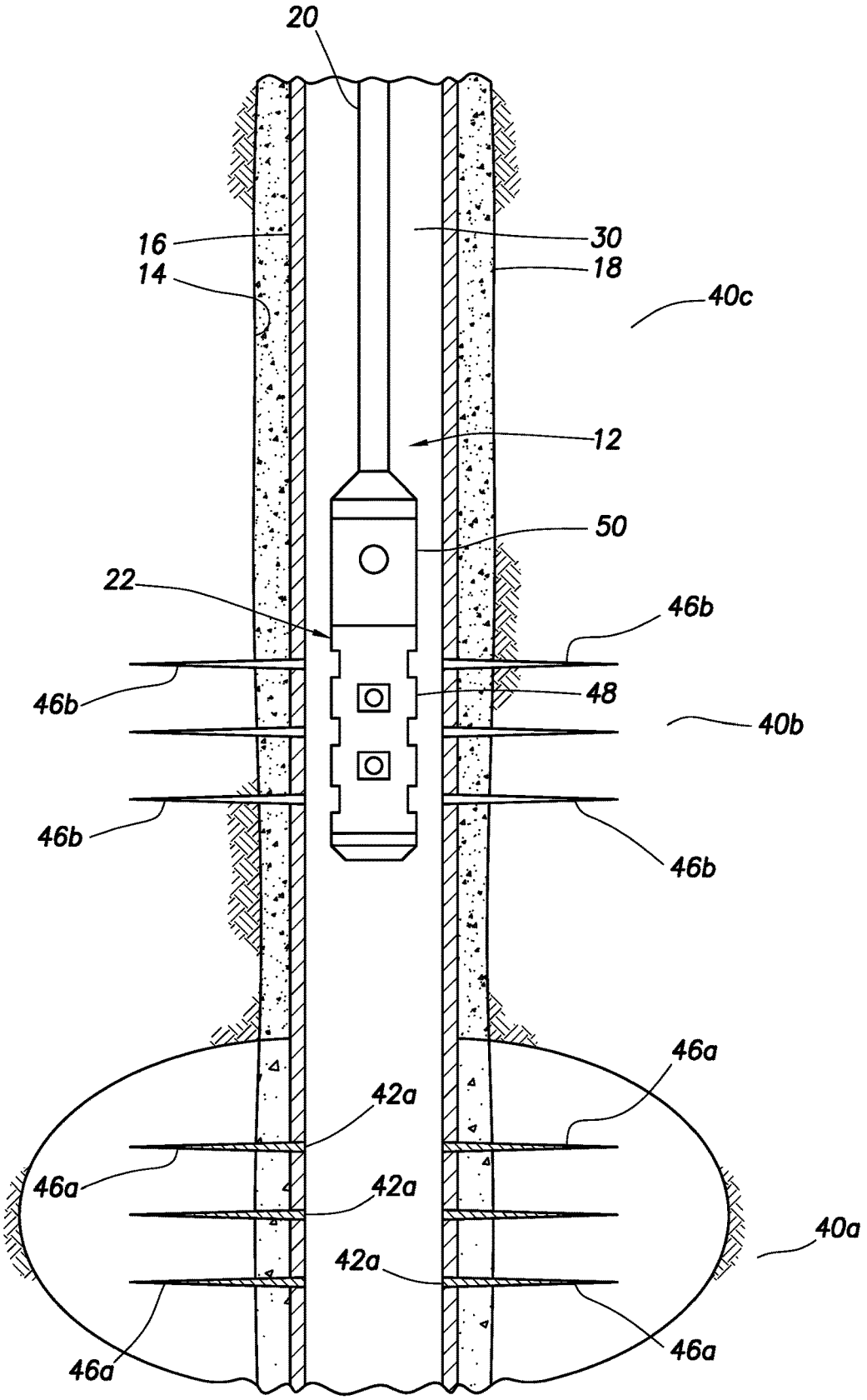

In FIG. 3B, the zone 40*a* has been fractured by applying increased pressure to the zone via the perforations 46*a*. The fracturing pressure may be applied, for example, via the annulus 30 from the surface (e.g., using the pump 34 of FIG. 1), or via the tubular string 12 (e.g., using the pump 36 of FIG. 1). The scope of this disclosure is not limited to any particular fracturing means or technique, or to the use of fracturing at all.

After fracturing of the zone 40*a*, the perforations 46*a* are plugged by deploying plugs 42*a* into the well and conveying them by fluid flow into sealing engagement with the perforations. The plugs 42*a* may be conveyed by flow 44 through the casing 16 (e.g., as in FIG. 2B), or by flow 52 through the tubular string 12 (e.g., as in FIG. 2C).

The tubular string 12 is repositioned in the casing 16, so that the perforator 48 is now located at the next zone 40*b* to be completed. The perforator 48 is then used to form perforations 46*b* through the casing 16 and cement 18, and into the zone 40*b*. The tubular string 12 may be repositioned before or after the plugs 42*a* are deployed into the well.

Figure 3C:
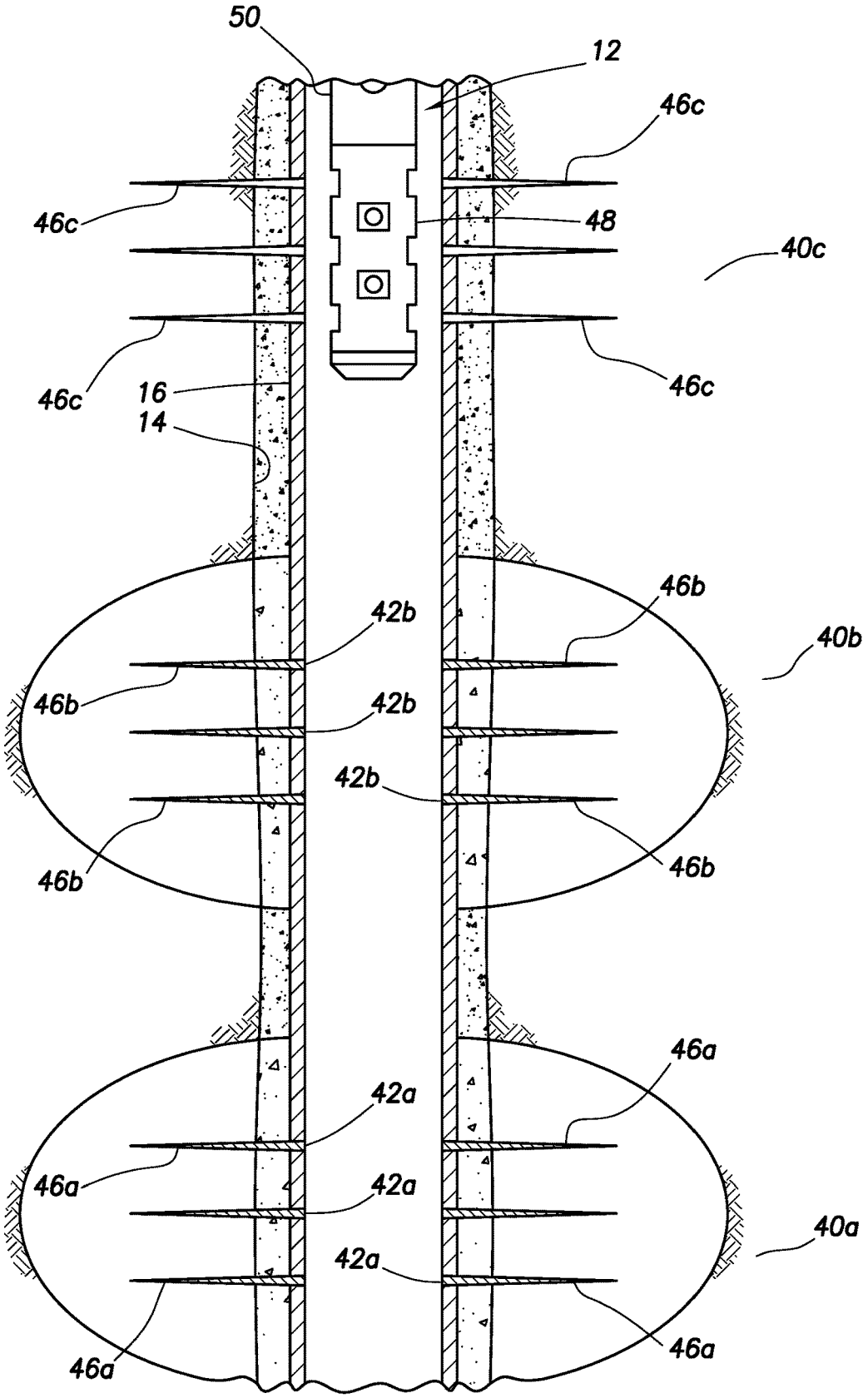

In FIG. 3C, the zone 40*b* has been fractured or otherwise stimulated by applying increased pressure to the zone via the perforations 46*b*. The pressure may be applied, for example, via the annulus 30 from the surface (e.g., using the pump 34 of FIG. 1), or via the tubular string 12 (e.g., using the pump 36 of FIG. 1).

After stimulation of the zone 40*b*, the perforations 46*b* are plugged by deploying plugs 42*b* into the well and conveying them by fluid flow into sealing engagement with the perforations. The plugs 42*b* may be conveyed by flow 44 through the casing 16, or by flow 52 through the tubular string 12.

The tubular string 12 is repositioned in the casing 16, so that the perforator 48 is now located at the next zone 40*c* to be completed. The perforator 48 is then used to form perforations 46*c* through the casing 16 and cement 18, and into the zone 40*c*. The tubular string 12 may be repositioned before or after the plugs 42*b* are deployed into the well.

Figure 3D:
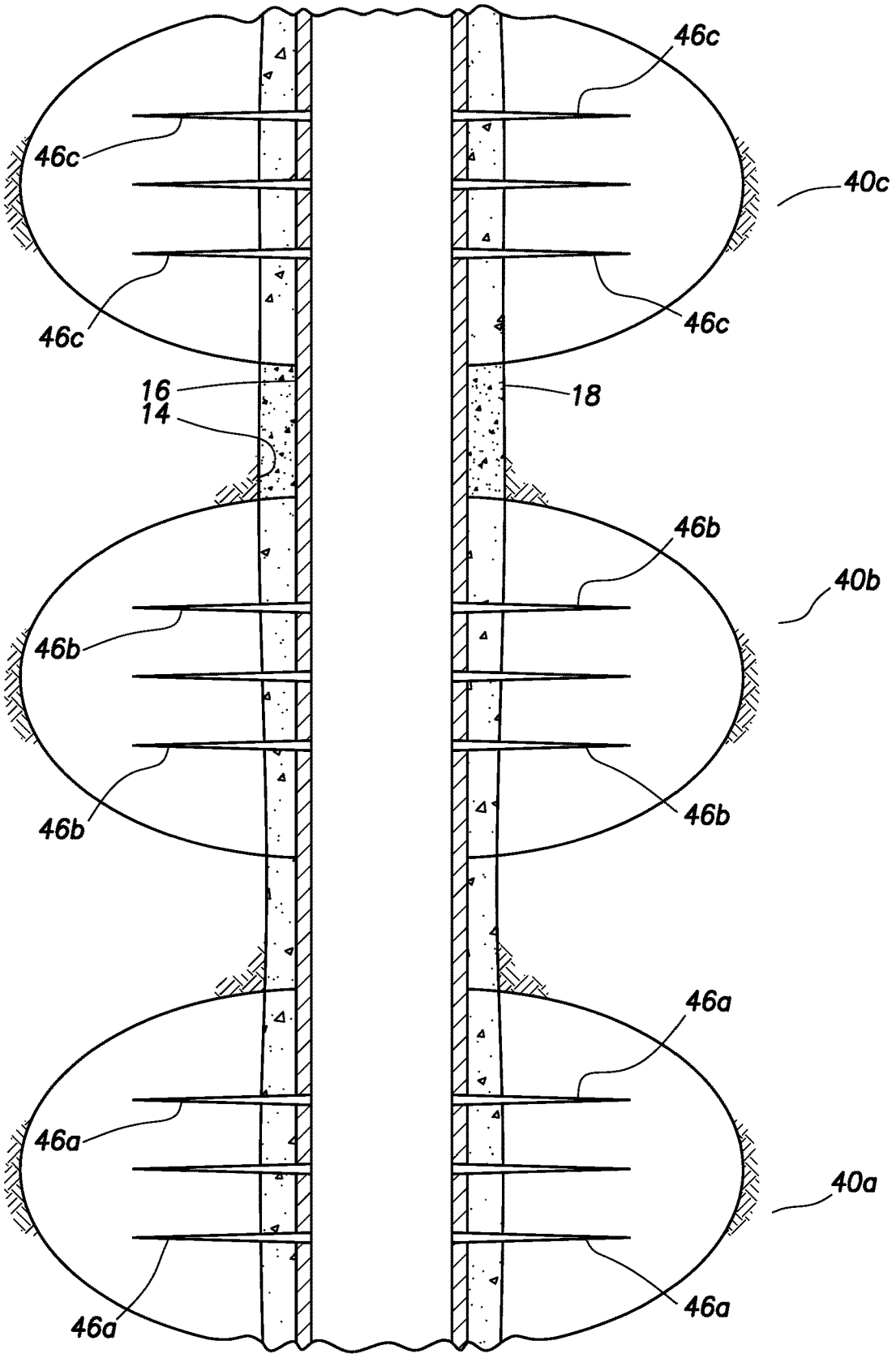

In FIG. 3D, the zone 40*c* has been fractured or otherwise stimulated by applying increased pressure to the zone via the perforations 46*c*. The pressure may be applied, for example, via the annulus 30 from the surface (e.g., using the pump 34 of FIG. 1), or via the tubular string 12 (e.g., using the pump 36 of FIG. 1).

After stimulation of the zone 40*c*, the perforations 46*c* could be plugged, if desired. For example, the perforations 46*c* could be plugged in order to verify that the plugs are properly blocking flow from the casing 16 to the zones 40*a-c*.

As depicted in FIG. 3D, the plugs 42*a,b* are degraded and no longer prevent flow through the perforations 46*a,b*. Thus, as depicted in FIG. 3D, flow is permitted between the interior of the casing 16 and each of the zones 40*a-c*.

The plugs 42*a,b* may be degraded in any manner. The plugs 42*a,b* may degrade in response to application of a degrading treatment, in response to passage of a certain period of time, or in response to exposure to elevated downhole temperature. The degrading treatment could include exposing the plugs 42*a,b* to a particular type of radiation, such as electromagnetic radiation (e.g., light having a certain wavelength or range of wavelengths, gamma rays, etc.) or "nuclear" particles (e.g., gamma, beta, alpha or neutron).

The plugs 42*a,b* may degrade by galvanic action or by dissolving. The plugs 42*a,b* may degrade in response to exposure to a particular fluid, either naturally occurring in the well (such as water or hydrocarbon fluid), or introduced therein.

The plugs 42*a,b* may be mechanically removed, instead of being degraded. The plugs 42*a,b* may be cut using a cutting tool (such as a mill or overshot), or an appropriately configured tool may be used to grab and pull the plugs from the perforations.

Note that any number of zones may be completed in any order in keeping with the principles of this disclosure. The zones 40*a-c* may be sections of a single earth formation, or they may be sections of separate formations.

Figure 4A:
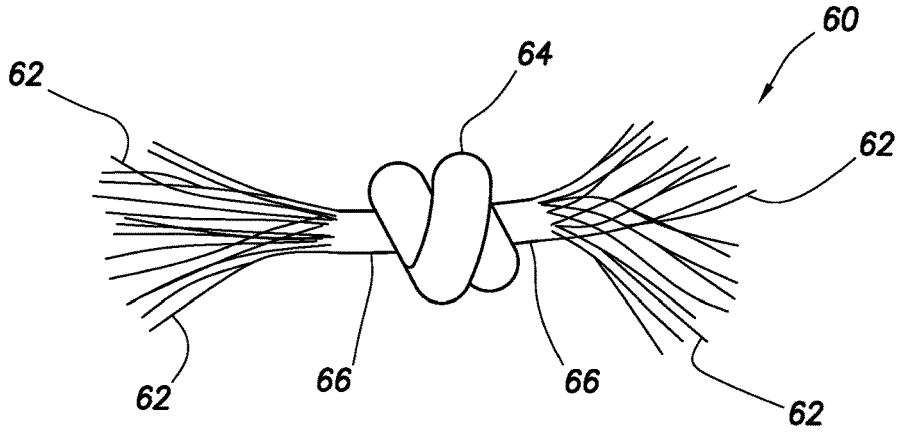
FIGS. 4A & B are enlarged scale representative elevational views of examples of a flow conveyed device that may be used in the system and methods of FIGS. 1-3D, and which can embody the principles of this disclosure.

Referring additionally now to FIG. 4A, an example of a flow conveyed plugging device 60 that can incorporate the principles of this disclosure is representatively illustrated. The device 60 may be used for any of the plugs 42, 42*a,b* described above in the method examples of FIGS. 2A-3D, or the device may be used in other methods.

The device 60 example of FIG. 4A includes multiple fibers 62 extending outwardly from an enlarged body 64. As depicted in FIG. 4A, each of the fibers 62 has a lateral dimension (e.g., a thickness or diameter) that is substantially smaller than a size (e.g., a thickness or diameter) of the body 64.

The body 64 can be dimensioned so that it will effectively engage and seal off a particular opening in a well. For example, if it is desired for the device 60 to seal off a perforation in a well, the body 64 can be formed so that it is somewhat larger than a diameter of the perforation. If it is desired for multiple devices 60 to seal off multiple openings having a variety of dimensions (such as holes caused by corrosion of the casing 16), then the bodies 64 of the devices can be formed with a corresponding variety of sizes.

In the FIG. 4A example, the fibers 62 are joined together (e.g., by braiding, weaving, cabling, etc.) to form lines 66 that extend outwardly from the body 64. In this example, there are two such lines 66, but any number of lines (including one) may be used in other examples.

The lines 66 may be in the form of one or more ropes, in which case the fibers 62 could comprise frayed ends of the rope(s). In addition, the body 64 could be formed by one or more knots in the rope(s). In some examples, the body 64 can comprise a fabric or cloth, the body could be formed by one or more knots in the fabric or cloth, and the fibers 62 could extend from the fabric or cloth. The body 64 could be formed from a single sheet of material or from multiple strips of sheet material.

In the FIG. 4A example, the body 64 is formed by a double overhand knot in a rope, and ends of the rope are frayed, so that the fibers 62 are splayed outward. In this manner, the fibers 62 will cause significant fluid drag when the device 60 is deployed into a flow stream, so that the device will be effectively "carried" by, and "follow," the flow.

However, it should be clearly understood that other types of bodies and other types of fibers may be used in other examples. The body 64 could have other shapes, the body could be hollow or solid, and the body could be made up of one or multiple materials. The fibers 62 are not necessarily joined by lines 66, and the fibers are not necessarily formed by fraying ends of ropes or other lines.

The body 64 is not necessarily formed from the same material as the lines 66. The body 64 could comprise a relatively large solid object, with the lines 66 (such as, fibers, ropes, fabric, sheets, cloths, tubes, films, twine, strings, etc.) attached thereto. Thus, the scope of this disclosure is not limited to the construction, configuration or other details of the device 60 as described herein or depicted in the drawings.

Figure 4B:
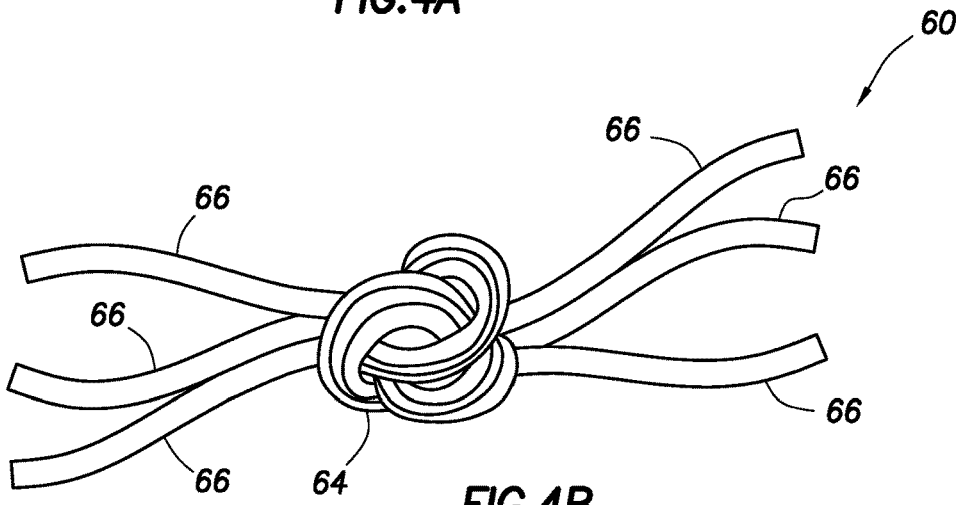

Referring additionally now to FIG. 4B, another example of the device 60 is representatively illustrated. In this example, the device 60 is formed using multiple braided lines 66 of the type known as "mason twine." The multiple lines 66 are knotted (such as, with a double or triple overhand knot or other type of knot) to form the body 64. Ends of the lines 66 are not necessarily be frayed in these examples, although the lines do comprise fibers (such as the fibers 62 described above).

Figure 5:
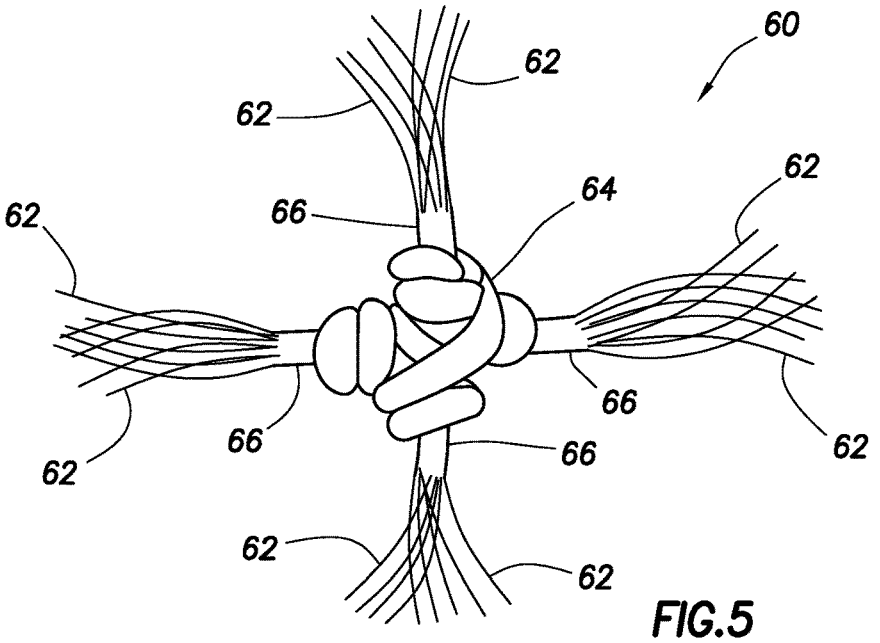
FIG. 5 is a representative elevational view of another example of the flow conveyed device.

Referring additionally now to FIG. 5, another example of the device 60 is representatively illustrated. In this example, four sets of the fibers 62 are joined by a corresponding number of lines 66 to the body 64. The body 64 is formed by one or more knots in the lines 66.

FIG. 5 demonstrates that a variety of different configurations are possible for the device 60. Accordingly, the principles of this disclosure can be incorporated into other configurations not specifically described herein or depicted in the drawings. Such other configurations may include fibers joined to bodies without use of lines, bodies formed by techniques other than knotting, etc.

Figure 6B:
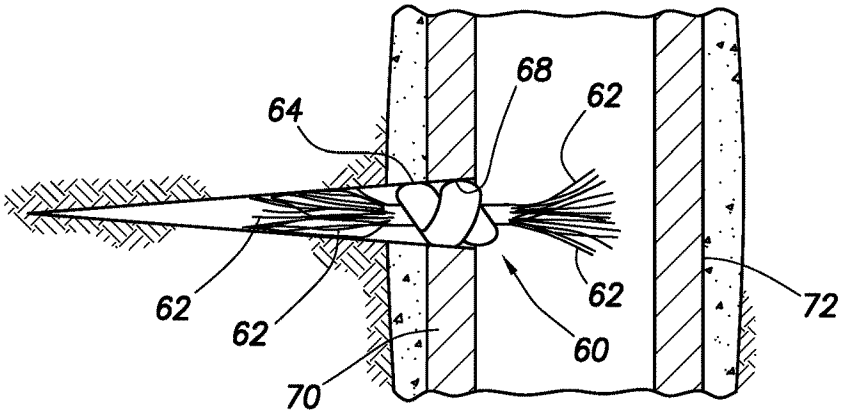
FIGS. 6A & B are representative partially cross-sectional views of the flow conveyed device in a well, the device being conveyed by flow in FIG. 6A, and engaging a casing opening in FIG. 6B.
Figure 6A:
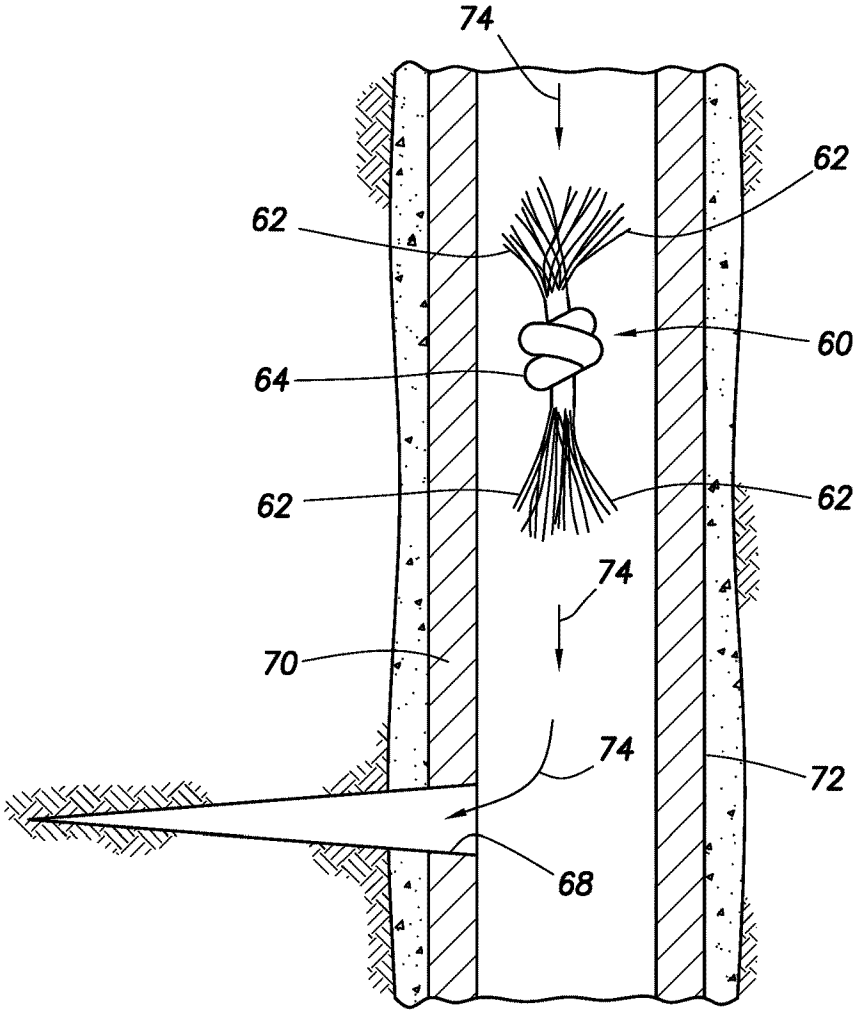

Referring additionally now to FIGS. 6A & B, an example of a use of the device 60 of FIG. 4 to seal off an opening 68 in a well is representatively illustrated. In this example, the opening 68 is a perforation formed through a sidewall 70 of a tubular string 72 (such as, a casing, liner, tubing, etc.). However, in other examples the opening 68 could be another type of opening, and may be formed in another type of structure.

The device 60 is deployed into the tubular string 72 and is conveyed through the tubular string by fluid flow 74. The lines 66 and fibers 62 of the device 60 enhance fluid drag on the device, so that the device is influenced to displace with the flow 74.

Since the flow 74 (or a portion thereof) exits the tubular string 72 via the opening 68, the device 60 will be influenced by the fluid drag to also exit the tubular string via the opening 68. As depicted in FIG. 6B, one set of the fibers 62/lines 66 first enters the opening 68, and the body 64 follows. However, the body 64 is appropriately dimensioned, so that it does not pass through the opening 68, but instead is lodged or wedged into the opening. In some examples, the body 64 may be received only partially in the opening 68, and in other examples the body may be entirely received in the opening.

The body 64 may completely or only partially block the flow 74 through the opening 68. If the body 64 only partially blocks the flow 74, any remaining fibers 62/lines 66 exposed to the flow in the tubular string 72 can be carried by that flow into any gaps between the body and the opening 68, so that a combination of the body and the fibers completely blocks flow through the opening.

In another example, the device 60 may partially block flow through the opening 68, and another material (such as, calcium carbonate, PLA or PGA particles) may be deployed and conveyed by the flow 74 into any gaps between the device and the opening, so that a combination of the device and the material completely blocks flow through the opening.

The device 60 may permanently prevent flow through the opening 68, or the device may degrade to eventually permit flow through the opening. If the device 60 degrades, it may be self-degrading, or it may be degraded in response to any of a variety of different stimuli. Any technique or means for degrading the device 60 (and any other material used in conjunction with the device to block flow through the opening 68) may be used in keeping with the scope of this disclosure.

If the device 60 is present in a well during or after an acidizing treatment, then at least the body 64 could be somewhat acid resistant. For example, a coating material on the body 64 could initially delay degradation of the body, but allow the body to degrade after a predetermined period of time. Alternatively, the device 60 could be mechanically removed after the acidizing treatment.

Figure 7:
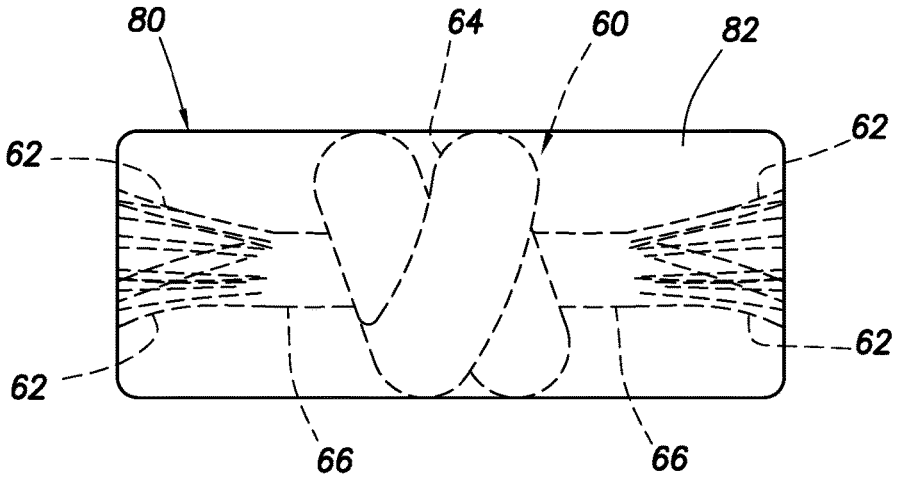
FIGS. 7-9 are representative elevational views of examples of the flow conveyed device with a retainer.
Figure 8:
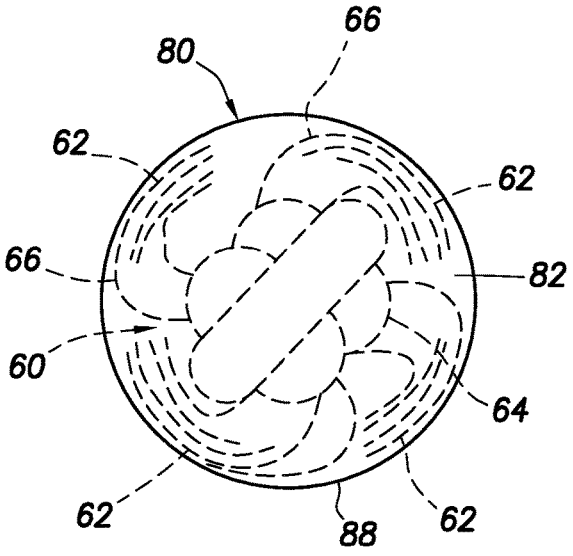
Figure 9:
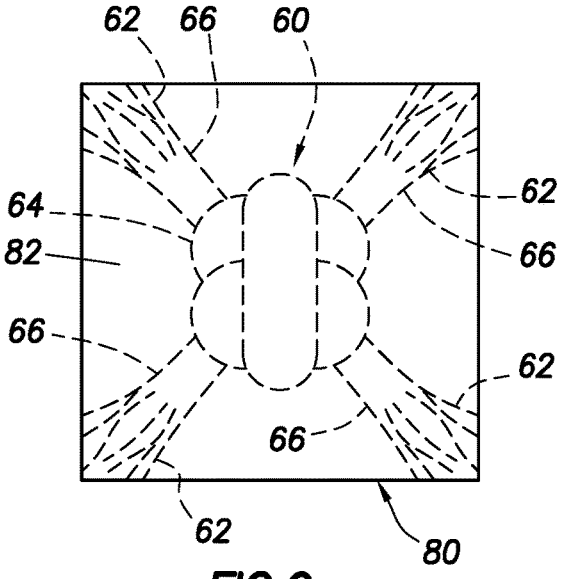

Referring additionally now to FIGS. 7-9, additional examples of the device 60 are representatively illustrated. In these examples, the device 60 is surrounded by, encapsulated in, molded in, or otherwise retained by, a retainer 80.

The retainer 80 aids in deployment of the device 60, particularly in situations where multiple devices are to be deployed simultaneously. In such situations, the retainer 80 for each device 60 prevents the fibers 62 and/or lines 66 from becoming entangled with the fibers and/or lines of other devices.

The retainer 80 could in some examples completely enclose the device 60. In other examples, the retainer 80 could be in the form of a binder that holds the fibers 62 and/or lines 66 together, so that they do not become entangled with those of other devices.

In some examples, the retainer 80 could have a cavity therein, with the device 60 (or only the fibers 62 and/or lines 66) being contained in the cavity. In other examples, the retainer 80 could be molded about the device 60 (or only the fibers 62 and/or lines 66).

During or after deployment of the device 60 into the well, the retainer 80 dissolves, disperses or otherwise degrades, so that the device is capable of sealing off an opening 68 in the well, as described above. For example, the retainer 80 can be made of a material 82 that degrades in a wellbore environment.

The retainer material 82 may degrade after deployment into the well, but before arrival of the device 60 at the opening 68 to be plugged. In other examples, the retainer material 82 may degrade at or after arrival of the device 60 at the opening 68 to be plugged. If the device 60 also comprises a degradable material, then preferably the retainer material 82 degrades prior to the device material.

The material 82 could, in some examples, melt at elevated wellbore temperatures. The material 82 could be chosen to have a melting point that is between a temperature at the earth's surface and a temperature at the opening 68, so that the material melts during transport from the surface to the downhole location of the opening.

The material 82 could, in some examples, dissolve when exposed to wellbore fluid. The material 82 could be chosen so that the material begins dissolving as soon as it is deployed into the wellbore 14 and contacts a certain fluid (such as, water, brine, hydrocarbon fluid, etc.) therein. In other examples, the fluid that initiates dissolving of the material 82 could have a certain pH range that causes the material to dissolve.

Note that it is not necessary for the material 82 to melt or dissolve in the well. Various other stimuli (such as, passage of time, elevated pressure, flow, turbulence, etc.) could cause the material 82 to disperse, degrade or otherwise cease to retain the device 60. The material 82 could degrade in response to any one, or a combination, of: passage of a predetermined period of time in the well, exposure to a predetermined temperature in the well, exposure to a predetermined fluid in the well, exposure to radiation in the well and exposure to a predetermined chemical composition in the well. Thus, the scope of this disclosure is not limited to any particular stimulus or technique for dispersing or degrading the material 82, or to any particular type of material.

In some examples, the material 82 can remain on the device 60, at least partially, when the device engages the opening 68. For example, the material 82 could continue to cover the body 64 (at least partially) when the body engages and seals off the opening 68. In such examples, the material 82 could advantageously comprise a relatively soft, viscous and/or resilient material, so that sealing between the device 60 and the opening 68 is enhanced.

Suitable relatively low melting point substances that may be used for the material 82 can include wax (e.g., paraffin wax, vegetable wax), ethylene-vinyl acetate copolymer (e.g., ELVAX™ available from DuPont), atactic polypropylene and eutectic alloys. Suitable relatively soft substances that may be used for the material 82 can include a soft silicone composition or a viscous liquid or gel.

Suitable dissolvable materials can include PLA, PGA, anhydrous boron compounds (such as anhydrous boric oxide and anhydrous sodium borate), polyvinyl alcohol, polyethylene oxide, salts and carbonates. The dissolution rate of a water-soluble polymer (e.g., polyvinyl alcohol, polyethylene oxide) can be increased by incorporating a water-soluble plasticizer (e.g., glycerin), or a rapidly-dissolving salt (e.g., sodium chloride, potassium chloride), or both a plasticizer and a salt.

In FIG. 7, the retainer 80 is in a cylindrical form. The device 60 is encapsulated in, or molded in, the retainer material 82. The fibers 62 and lines 66 are, thus, prevented from becoming entwined with the fibers and lines of any other devices 60.

In FIG. 8, the retainer 80 is in a spherical form. In addition, the device 60 is compacted, and its compacted shape is retained by the retainer material 82. A shape of the retainer 80 can be chosen as appropriate for a particular device 60 shape, in compacted or un-compacted form.

In FIG. 9, the retainer 80 is in a cubic form. Thus, any type of shape (polyhedron, spherical, cylindrical, etc.) may be used for the retainer 80, in keeping with the principles of this disclosure.

Figure 10:
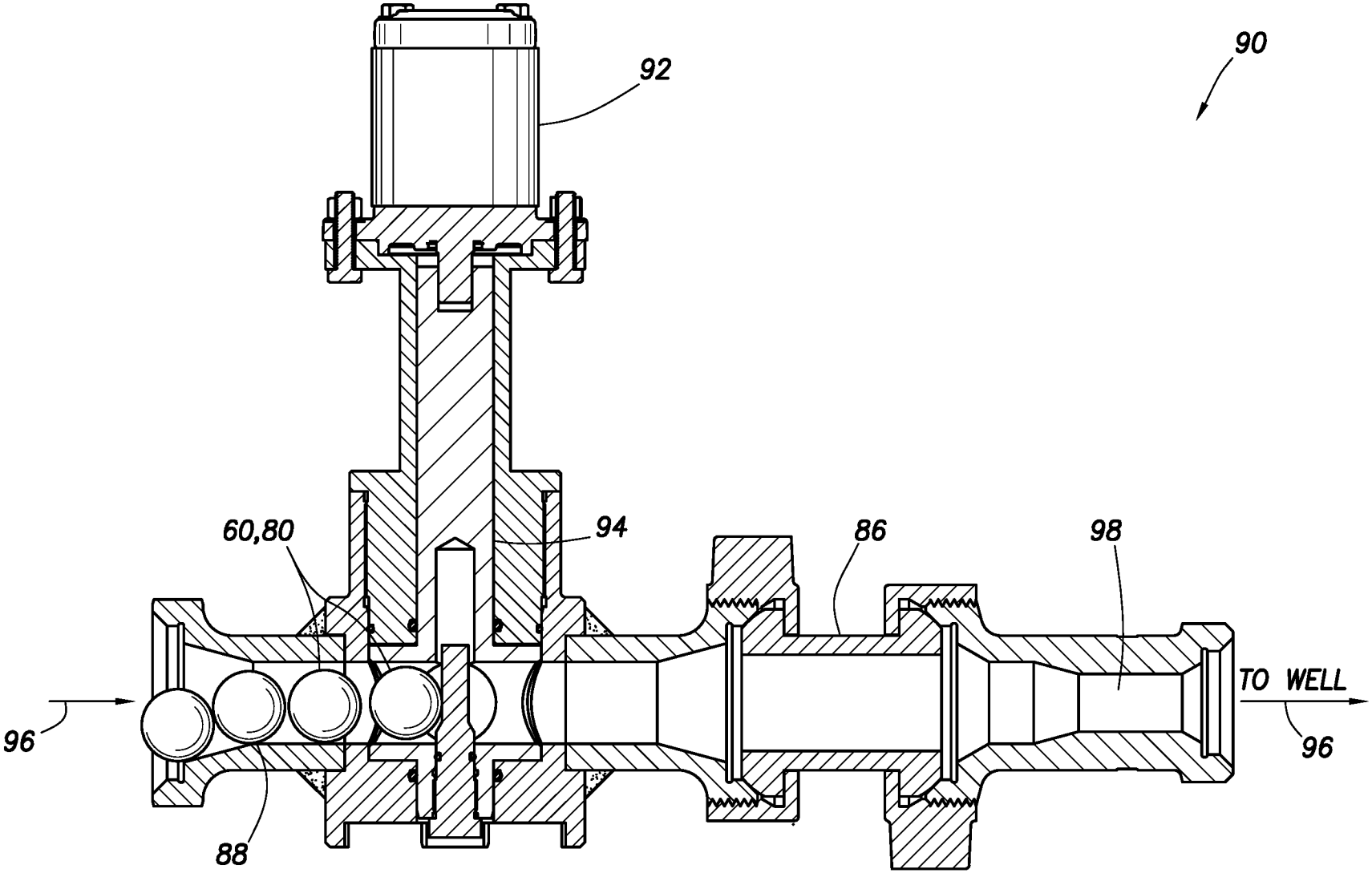
FIG. 10 is a representative cross-sectional view of an example of a deployment apparatus and method that can embody the principles of this disclosure.

Referring additionally now to FIG. 10, an example of a deployment apparatus 90 and an associated method are representatively illustrated. The apparatus 90 and method may be used with the system 10 and method described above, or they may be used with other systems and methods.

When used with the system 10, the apparatus 90 can be connected between the pump 34 and the casing valve 32 (see FIG. 1). Alternatively, the apparatus 90 can be "teed" into a pipe associated with the pump 34 and casing valve 32, or into a pipe associated with the pump 36 (for example, if the devices 60 are to be deployed via the tubular string 12). However configured, an output of the apparatus 90 is connected to the well, although the apparatus itself may be positioned a distance away from the well.

The apparatus 90 is used in this example to deploy the devices 60 into the well. The devices 60 may or may not be retained by the retainer 80 when they are deployed. However, in the FIG. 10 example, the devices 60 are depicted with the retainers 80, for convenience of deployment. The retainer material 82 is at least partially dispersed during the deployment method, so that the devices 60 are more readily conveyed by the flow 74.

In certain situations, it can be advantageous to provide spacing between the devices 60 during deployment, for example, in order to efficiently plug casing perforations. One reason for this is that the devices 60 will tend to first plug perforations that are receiving highest rates of flow.

In addition, if the devices 60 are deployed downhole too close together, some of them can become trapped between perforations, thereby wasting some of the devices. The excess "wasted" devices 60 can later interfere with other well operations.

To mitigate such problems, the devices 60 can be deployed with a selected spacing. The spacing may be, for example, on the order of the length of the perforation interval. The apparatus 90 is desirably capable of deploying the devices 60 with any selected spacing between the devices.

Each device 60 in this example has the retainer 80 in the form of a dissolvable coating material with a frangible coating 88 (see FIG. 8) thereon, to impart a desired geometric shape (spherical in this example), and to allow for convenient deployment. The dissolvable retainer material 82 could be detrimental to the operation of the device 60 if it increases a drag coefficient of the device. A high coefficient of drag can cause the devices 60 to be swept to a lower end of the perforation interval, instead of sealing uppermost perforations.

The frangible coating 88 is used to prevent the dissolvable coating from dissolving during a queue time prior to deployment. Using the apparatus 90, the frangible coating 88 can be desirably broken, opened or otherwise damaged during the deployment process, so that the dissolvable coating is then exposed to fluids that can cause the coating to dissolve.

Examples of suitable frangible coatings include cementitious materials (e.g., plaster of Paris) and various waxes (e.g., paraffin wax, carnauba wax, vegetable wax, machinable wax). The frangible nature of a wax coating can be optimized for particular conditions by blending a less brittle wax (e.g., paraffin wax) with a more brittle wax (e.g., carnauba wax) in a certain ratio selected for the particular conditions.

As depicted in FIG. 10, the apparatus 90 includes a rotary actuator 92 (such as, a hydraulic or electric servo motor, with or without a rotary encoder). The actuator 92 rotates a sequential release structure 94 that receives each device 60 in turn from a queue of the devices, and then releases each device one at a time into a conduit 86 that is connected to the tubular string 72 (or the casing 16 or tubing 20 of FIG. 1).

Note that it is not necessary for the actuator 92 to be a rotary actuator, since other types of actuators (such as, a linear actuator) may be used in other examples. In addition, it is not necessary for only a single device 60 to be deployed at a time. In other examples, the release structure 94 could be configured to release multiple devices at a time. Thus, the scope of this disclosure is not limited to any particular details of the apparatus 90 or the associated method as described herein or depicted in the drawings.

In the FIG. 10 example, a rate of deployment of the devices 60 is determined by an actuation speed of the actuator 92. As a speed of rotation of the structure 94 increases, a rate of release of the devices 60 from the structure accordingly increases. Thus, the deployment rate can be conveniently adjusted by adjusting an operational speed of the actuator 92. This adjustment could be automatic, in response to well conditions, stimulation treatment parameters, flow rate variations, etc.

As depicted in FIG. 10, a liquid flow 96 enters the apparatus 90 from the left and exits on the right (for example, at about 1 barrel per minute). Note that the flow 96 is allowed to pass through the apparatus 90 at any position of the release structure 94 (the release structure is configured to permit flow through the structure at any of its positions).

When the release structure 94 rotates, one or more of the devices 60 received in the structure rotates with the structure. When a device 60 is on a downstream side of the release structure 94, the flow 96 though the apparatus 90 carries the device to the right (as depicted in FIG. 10) and into a restriction 98.

The restriction 98 in this example is smaller than the diameter of the retainer 80. The flow 96 causes the device 60 to be forced through the restriction 98, and the frangible coating 88 is thereby damaged, opened or fractured to allow the inner dissolvable material of the retainer 80 to dissolve.

Other ways of opening, breaking or damaging a frangible coating may be used in keeping with the principles of this disclosure. For example, cutters or abrasive structures could contact an outside surface of a retainer 80 to penetrate, break or otherwise damage the frangible coating 88. Thus, this disclosure is not limited to any particular technique for damaging, breaking, penetrating or otherwise compromising a frangible coating.

Note that it is not necessary for the restriction 98 to open, break or damage a frangible coating. In some examples, a frangible coating may not be provided on the device 60. In those examples, the restriction 98 could initiate degradation of the retainer 80 (e.g., when the retainer material comprises paraffin wax). The restriction 98 could mechanically compress, damage, fracture, open, penetrate, cut, compromise or break the retainer 80, and thereby expose additional surface area of the retainer to degradation by exposure to heat, fluids, etc. in the well.

In some examples, the restriction 98 could be used to initiate degradation of the device 60. For example, the retainer 80 may not be used, or the retainer may be incorporated into the device. In those examples, the restriction 98 could have an interior dimension that is smaller than an external dimension of the device 60, or could have cutters or abrasive structures to contact an outside surface of the device and thereby damage, break, penetrate or otherwise compromise the device, so that it more readily degrades in the well.

Figure 11:
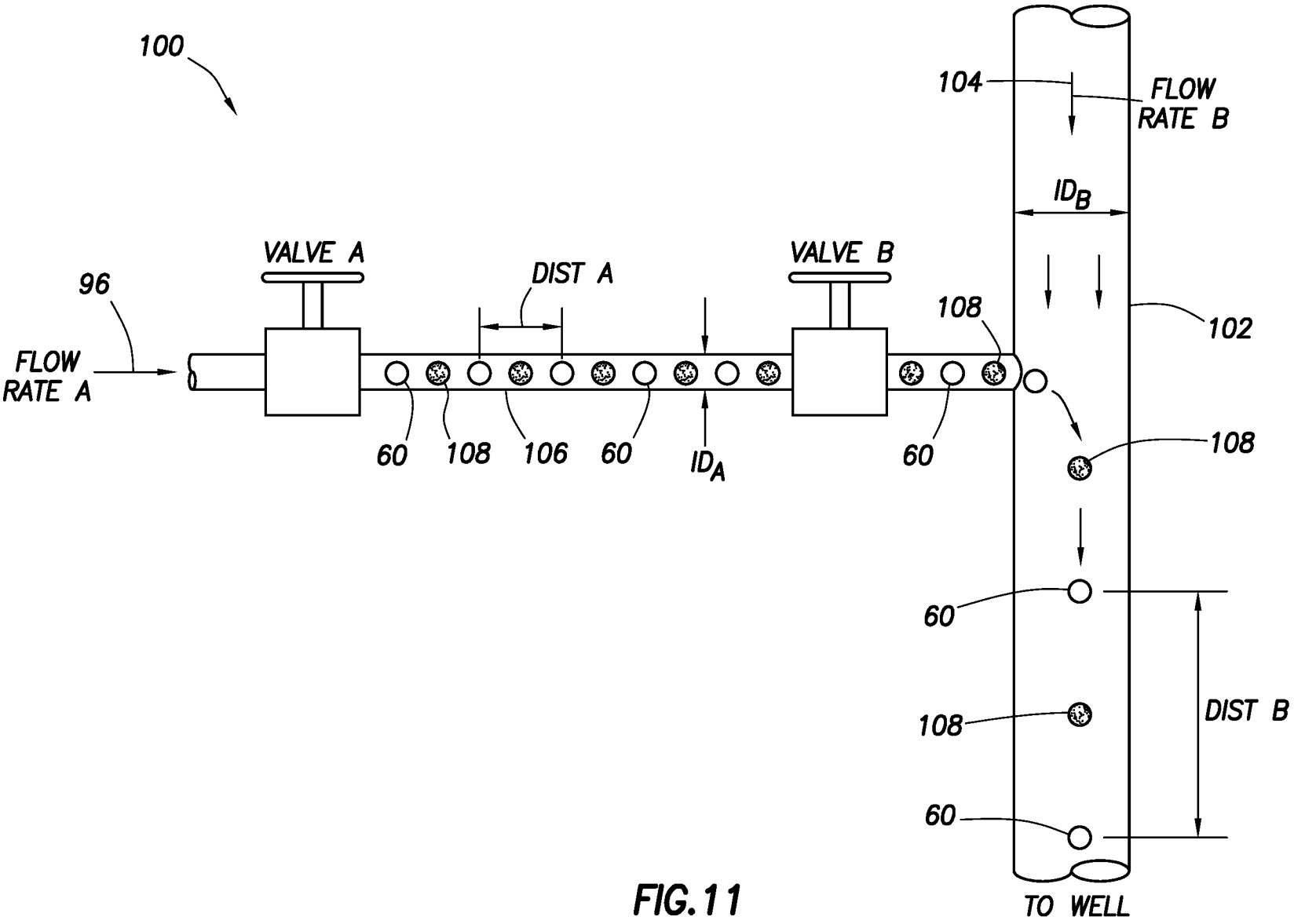
FIG. 11 is a representative schematic view of another example of a deployment apparatus and method that can embody the principles of this disclosure.

Referring additionally now to FIG. 11, another example of a deployment apparatus 100 and an associated method are representatively illustrated. The apparatus 100 and method may be used with the system 10 and method described above, or they may be used with other systems and methods.

In the FIG. 11 example, the devices 60 are deployed using two flow rates. Flow rate A through two valves (valves A & B) is combined with Flow rate B through a pipe 102 (such as casing 16 or tubular string 72) depicted as being vertical in FIG. 11 (the pipe may be horizontal or have any other orientation in actual practice).

The pipe 102 may receive flow via the pump 34 and casing valve 32, or the pipe may receive flow via the pump 36 if the devices 60 are to be deployed via the tubular string 12. In some examples, a separate pump (not shown) may be used to supply the flow 96 through the valves A & B.

Valve A is not absolutely necessary. When valve B is open the flow 96 causes the devices 60 to enter the vertical pipe 102. Flow 104 through the vertical pipe 102 in this example is substantially greater than the flow 96 through the valves A & B (that is, flow rate B>>flow rate A), although in other examples the flows may be substantially equal or otherwise related.

A spacing (dist. B) between the devices 60 when they are deployed into the well can be calculated as follows: dist. B=dist. A*$(ID_A^2/ID_B^2)$*(flow rate B/flow rate A), where dist. A is a spacing between the devices 60 prior to entering the pipe 102, $ID_A$ is an inner diameter of a pipe 106 connected to the pipe 102, and $ID_B$ is an inner diameter of the pipe 102 (such as, the casing 16 or tubular string 72). This assumes circular pipes 102, 106. Where corresponding passages are non-circular, the term $ID_A^2/ID_B^2$ can be replaced by an appropriate ratio of passage areas.

The spacing between the plugging devices 60 in the well (dist. B) can be automatically controlled by varying at least one of the flow rates. For example, the spacing can be increased by increasing the flow rate B or decreasing the flow rate A. The flow rate(s) can be automatically adjusted in response to changes in well conditions, stimulation treatment parameters, flow rate variations, etc.

In some examples, flow rate A can have a practical minimum of about ½ barrel per minute. In some circumstances, the desired deployment spacing (dist. B) may be greater than what can be produced using a convenient spacing of the devices 60 and the flow rate A in the pipe 106.

The deployment spacing B may be increased by adding spacers 108 between the devices 60 in the pipe 106. The spacers 108 effectively increase the distance A between the devices 60 in the pipe 106 (and, thus, increase the value of dist. A in the equation above).

The spacers 108 may be dissolvable or otherwise dispersible, so that they dissolve or degrade when they are in the pipe 102 or thereafter. In some examples, the spacers 108 may be geometrically the same as, or similar to, the devices 60.

Note that the apparatus 100 may be used in combination with the restriction 98 of FIG. 10 (for example, with the restriction 98 connected downstream of the valve B but upstream of the pipe 102). In this manner, a frangible or other protective coating 88 on the devices 60 and/or spacers 108 can be opened, broken or otherwise damaged prior to the devices and spacers entering the pipe 102.

It may now be fully appreciated that the above disclosure provides significant advancements to the art of controlling flow in subterranean wells. In some examples described above, the device 60 may be used to block flow through openings in a well, with the device being uniquely configured so that its conveyance with the flow is enhanced. A deployment apparatus 100 can be used to deploy the devices 60 into the well, so that a desired spacing between the devices is achieved.

The above disclosure provides to the art a method of deploying plugging devices 60 in a well. In one example, the method can include operating an actuator 92, thereby displacing a release structure 94. The release structure 94 releases the plugging devices 60 into the well in response to the operating step.

The method may include controlling a rate of release of the plugging devices 60. The controlling step can be performed by controlling an operational speed of the actuator 92. The controlling step may be performed by automatically controlling the actuator 92, thereby automatically controlling the rate of release of the plugging devices 60.

The actuator 92 may rotate the release structure 94. The releasing step may include passing a fluid flow 96 through the release structure 94.

The method can include initiating degradation of the plugging devices 60 or a retainer 80 that retains of each of the plugging devices 60. The initiating step may be performed by opening a frangible coating 88 on each of the retainers 80. The initiating step may be performed by forcing the plugging devices 60 through a restriction 98. The initiating may be performed by damaging, breaking or opening the retainer 80.

A deployment apparatus 90 for deploying plugging devices 60 in a well is also provided to the art by the above disclosure. In one example, the deployment apparatus 90 can comprise an actuator 92 and a release structure 94 that releases the plugging devices 60 into a conduit 86 connected to a tubular string 72 in the well.

A rate of release of the plugging devices 60 may be proportional to an operational speed of the actuator 92.

The deployment apparatus 90 can include a restriction 98 that initiates degradation of the plugging devices 60 or a retainer 80 that retains each of the plugging devices 60.

The restriction 98 may open a frangible coating 88 on each of the retainers 80.

Another method of deploying plugging devices 60 in a well can comprise: selectively displacing the plugging devices 60 through a first pipe 106 that intersects a second pipe 102; controlling a first fluid flow rate through the first pipe 106; and controlling a second fluid flow rate through the second pipe 102. A spacing between the plugging devices 60 deployed into the well is proportional to a ratio of the first and second flow rates.

The method may include varying the spacing by varying at least one of the first and second flow rates.

The method may include automatically varying the spacing by automatically varying at least one of the first and second flow rates.

The spacing between the plugging devices 60 in the well may be determined by the following equation: dist. B=dist. $A*(ID_A^2/ID_B^2)*$(flow rate B/flow rate A), where dist. B is the spacing between the plugging devices in the well, dist. A is a spacing between the plugging devices in the first pipe 106, $ID_A$ is an inner dimension of the first pipe 106, $ID_B$ is an inner dimension of the second pipe 102, flow rate A is the first flow rate through the first pipe 106, and flow rate B is the second flow rate through the second pipe 102.

The method may include interposing spacers 108 between the plugging devices 60.

Another deployment apparatus 100 for deploying plugging devices 60 in a well is described above. In one example, the deployment apparatus 100 comprises intersecting first and second pipes 106, 102 and a valve B that selectively permits and prevents displacement of the plugging devices 60 through the first pipe 106. A spacing between the plugging devices 60 deployed into the well is proportional to a ratio of first and second flow rates through the respective first and second intersecting pipes 106, 102.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of deploying plugging devices in a well, the method comprising:

flowing a fluid through a conduit containing an uninterrupted queue of the plugging devices, wherein the queue is obstructed from passing through the conduit by a release structure;

then operating an actuator, thereby displacing the release structure; and the release structure only releasing a portion of the queue of the plugging devices at a time into the well in response to the operating, wherein the releasing further comprises the fluid flow carrying the portion of the queue of the plugging devices from the conduit into the well.

2. The method of claim 1, further comprising controlling a rate of release of the plugging devices.

3. The method of claim 2, wherein the controlling is performed by controlling an operational speed of the actuator.

4. The method of claim 2, wherein the controlling is performed by automatically controlling the actuator, thereby automatically controlling the rate of release of the plugging devices.

5. The method of claim 1, wherein the actuator rotates the release structure.

6. The method of claim 1, further comprising initiating degradation of the plugging devices.

7. The method of claim 6, wherein the initiating is performed by opening a frangible coating on retainers that retain the plugging devices.

8. The method of claim 6, wherein the initiating is performed by forcing the plugging devices through a restriction.

9. The method of claim 6, wherein the initiating is performed by damaging, breaking or opening retainers that retain the plugging devices.

10. A deployment apparatus for deploying plugging devices in a well, the deployment apparatus comprising:

a first conduit containing an uninterrupted queue of the plugging devices, wherein a fluid flow passes through the first conduit;

a release structure that obstructs passage of the queue through the first conduit; and an actuator that is configured to displace the release structure, wherein the release structure is adapted to only release a portion of the queue of the plugging devices at a time into a second conduit connected to a tubular string in the well, and wherein the fluid flow carries the portion of the queue of the plugging devices from the first conduit, through the second conduit, and into the tubular string.

11. The deployment apparatus of claim 10, wherein the actuator rotates the release structure.

12. The deployment apparatus of claim 10, wherein a rate of release of the plugging devices is proportional to an operational speed of the actuator.

13. The deployment apparatus of claim 10, further comprising a restriction that initiates degradation of the plugging devices.

14. The deployment apparatus of claim 13, wherein the restriction opens a frangible coating on retainers that retain the plugging devices.

* * * * *